US006116996A

United States Patent [19]

Yanase

[11] Patent Number: 6,116,996

[45] Date of Patent: Sep. 12, 2000

[54] ROTARY GRINDING JIG

[75] Inventor: Isamu Yanase, Hikami-gun, Japan

[73] Assignee: Yanase Kabushiki Kaisha, Hyogo, Japan

[21] Appl. No.: 09/153,854

[22] Filed: Sep. 16, 1998

[30] Foreign Application Priority Data

Sep. 29, 1997 [JP] Japan ..... 9-282659

[51] Int. Cl.[7] ..... A47L 11/14

[52] U.S. Cl. ..... 451/359; 451/508

[58] Field of Search ..... 451/359, 508–510

[56] References Cited

U.S. PATENT DOCUMENTS

| | | | |
|---|---|---|---|
| 2,478,074 | 8/1949 | Atkin | 451/359 |
| 3,623,281 | 11/1971 | Moffat | 451/509 |
| 5,538,464 | 7/1996 | Mackay, Jr. | 451/510 X |
| 5,558,571 | 9/1996 | Toyoshima et al. | 451/359 X |
| 5,619,770 | 4/1997 | Bell | 451/508 X |

*Primary Examiner*—David A. Scherbel
*Assistant Examiner*—Anthony Ojini
*Attorney, Agent, or Firm*—Birch, Stewart, Kolasch & Birch, LLP

[57] ABSTRACT

The present invention relates to a rotary grinding jig for use with the rotating shaft of a grinder and the like. The rotary grinding jig includes a base and a grinding member. The base is composed of a central member adapted to be fixed to the rotating shaft of the grinder and a retaining member for the grinding member to be adhesively attached to the grinding member . The central member and the retaining member for the grinding member are removably engaged with each other by means of ridges. The central member can be firmly secured to the rotary shaft by a fixing screw, and the retaining member for the grinding member can be removed with the central member remaining attached to the rotary shaft. If the grinding member wears out, only the retaining member for the grinding member and the grinding member may be thrown away and exchanged for new ones. Additionally, the retaining member for the grinding member may be of a two-piece type; one member can be repetitively used while the other one may be discarded, so that waste can be reduced to a minimum. A stopper for preventing dissolution of the rotative engagement of the retaining member for the grinding member and a means for preventing the retaining member for the grinding member from dropping out of the central member are provided.

8 Claims, 22 Drawing Sheets

(A)

(B)

ROTARY GRINDING JIG

BACKGROUND OF THE INVENTION

1. Field of the Invention

The present invention relates to a rotary grinding jig for use with the rotating shaft of a rotary drive of a grinder and the like having driving mechanisms of various sorts, in an arrangement such that the rotary grinding jig is firmly secured to said rotating shaft.

2. Description of Related Art

FIG. 22 is a central sectional view explanatory of conventional rotary grinding jigs of a same type, (A) showing the one before use, and (B) the other one with a worn-out grinding member after use.

This prior art rotary grinding jig comprises a disk-shaped base 100 made of resin or metal and a grinding member 200 stuck to the surface 101 of said base by adhesive.

The grinding member 200 is composed of a plurality of substantially rectangular grinding cloths 201, . . . 201 overlapped with each other in a radial arrangement.

Said rotary grinding jig can be fixed to the rotary shaft of the grinder by inserting a rotary shaft of the grinder (not shown), having a male screw portion formed on the end thereof from below upward into a rotating shaft mounting hole 102 formed in the center of the base, mounting a nut onto the male screw portion of the rotating shaft, and tightening said nut by a clamping tool.

If the grinding member 200 has work out, the whole rotary grinding member will be thrown away together with the base 100, as shown in FIG. 22(B).

Though not shown here, there exists a rotary grinding jig wherein the base and the grinding member are in close but removable contact with each other by an area fastener.

As aforementioned, with the conventional rotary grinding jig having the grinding member 200 adhered to the base 100 made of resin or metal, if the grinding member 200 has entirely worn out, the entire grinding jig must be discarded.

However, considering that the whole grinding jig must be discarded together with the base, it is a concern that this may greatly affect the environment. In addition, discarding the entire grinding jig is also not preferable in view of the saving in resources,. Furthermore, the material cost is also not negligible for manufacturers.

In case of the exchange of the rotary grinding jig, a spent grinding jig is removed from the rotating shaft of the grinder by loosening the nut by a tool, and then, a new grinding jig is mounted onto the rotating shaft of the grinder, the rotating shaft is tightened using the tool again for further fixing the grinding jig thereto. This takes a great deal of trouble and the workability as well as the working efficiency are very low. On the other hand, there lies a big problem in that with the grinding member and the base removably fixed to each other by an area fastener, the mounting strength or fixing strength is poor.

In this connection, the present invention has for its object the resolution of the above-described problem and for its task the following matters.

The rotary grinding jig must be so designed that if the grinding member has uselessly worn out, waste portions of the rotary grinding jig may be reduced to a minimum. This may reduce industrial wastes, avoid any adverse influence against the environment, contribute to saving energy, and lead to a cut in production cost as well.

A worn-out and useless rotary grinding jig must be exchanged for a new one by a very simple one-touch control.

This may execute the exchange of the grinding jig simply and in a short time, thus resulting in improvement of the workability and working efficiency.

Such a one-touch control system for exchange of the grinding jig must not cause any loss of mounting strength for the grinding jig. The removable fixing by the conventional area fastener cannot assure a sufficient mounting strength, therefore, additional fixing means such as screws for maintaining the strength was used.

Moreover, there must be provided a means for preventing the grinding jig which has been mounted by a one-touch control from simply coming off its position. That is, a means must be provided for preventing any dissolution of the engagement achieved by such a one-touch control and any possible dropout of the grinding member or retaining member for the grinding member of the rotary grinding jig even though the rotary drive of a grinder has stopped all of a sudden.

Additionally, a further task of the present invention is to provide a rotary grinding jig which may be produced by using every type of grinding member, such as a grindstone, integral structure of a grindstone and resin, abrasive paper, feather cloth, rubber, etc.

SUMMARY OF THE INVENTION

For the purpose of solving the above tasks, a first embodiment of the present application provides a rotary grinding jig including a disk-like base having a grinding member (2) such as abrasive cloth or a grindstone provided on the surface thereof, and a connecting portion **(5*e*) formed in the center thereof so as to be connected with the rotating shaft of a rotary drive, characterized in that the base comprises a retaining member (11) for the grinding member provided with the grinding member (2) and a central member (5) having said connecting portion (5*e*), that said retaining member (11) for the grinding member includes a hollow portion (11*c*) consisting of a through-hole in the center thereof and having a rotative engagement portion (11*d*) defined on the inner edge portion thereof or close thereto, that the rotative engagement portion (5*d*) engaged with said rotative engagement portion (11*d*) is provided on the central member (5), that the rotative engagement portion (11*d*) of the retaining member (11) for the grinding member is adapted to engage with the rotative engagement portion (5*d*) of the central member (5) by turning in a direction opposite to the direction in which the rotating shaft of the rotary drive rotates, and that such a resulted engagement is dissolved by turning the rotative engagement portion (11*d*) in a reverse direction, whereby the rotation of the rotating shaft of the rotary drive may cause further increase of mutual locking between both rotary engagement portions (11*d*) (5*d*), that the connecting portion (5*e*) of the central member (5) consists of a rotating shaft mounting hole, the rotating shaft of the rotary drive is inserted into said connecting portion (5*e*) so that the central member (5) may be fixed to the rotating shaft of the rotary drive by a fixing means such as a nut or bolt, that the outer diameter of said fixing means is made smaller than the inner diameter of the hollow portion (11*c*) of said retaining member (11) for the grinding member, whereby the retaining member (11) for the grinding member may be separated with the central member (5)** remaining fixed to the rotating shaft.

Since the base is composed of the retaining member 11 for the grinding member and the central member 5 defined separate from each other, if the grinding member 2 has entirely worn out, only the grinding member 2 and the retaining member 11 for the grinding member may be thrown away, while the central member 5 may be left behind for further use, thereby contributing to environmental protection, saving energy, and a reduction in production cost.

The retaining member 11 and the central member 5 are removably fixed to each other by the rotative engagement portion, so that both members are easy to engage and disengage.

Referring to the engagement means of the retaining member 11 and the central member 5, since the engagement of both members is loaded in a direction in which it is further tightened by the rotation of the rotating shaft of the rotary drive, the engagement of both members will never be dissolved during the grinding operation.

Because the outer diameter of the fixing means for fixing the central member 5 to the rotating shaft is smaller than the inner diameter of the hollow portion 11*c* of the retaining member 11, only the retaining member 11 and the grinding member 5 may be removed with the central member 5 remaining fixed to the rotating shaft.

A second embodiment of the present application provides the rotary grinding jig as defined in the first embodiment, characterized in that the grinding member 2 and the retaining member 11 are hard structures made of grindstones and resin and formed integral with each other.

The described integrally molded structure of hard quality made of a grindstone and resin implies an integral structure produced such as by admixing abrasive powders and abrasive particles with resin, and subjecting the resultant mixture to press molding and sintering.

Since the grinding member 2 and the retaining member 11 are formed as an integrally molded structure of hard quality, a separate retaining member 11 is not needed.

A third embodiment of the present application provides the rotary grinding jig as defined in the first embodiment, characterized in that the retaining member (11) is constituted by a first retaining member (11*a*) positioned in the center side and a second retaining member (11*b*) positioned in the outside thereof, that said second retaining member (11*b*) is removably attached to said first retaining member (11*a*), that the first retaining member (11*a*) is removably engaged with the central member (5), and that a grinding operation may be continued by removing the second retaining member (11*b*) from the first retaining member (11*a*) according to the attrition of the grinding member (2).

In the third embodiment, the base is composed of three members, i.e. the central member, the first retaining member, and the second retaining member. The central member and the second retaining member can be repetitively used. Only the worn-out grinding member and the first retaining member are thrown away. The grinding member can be used until it reaches the limit of its usefulness, thus resulting in a more diminished quantity of waste on the disposal of an entirely worn-out grinding member. This may contribute to saving resources, the environmental protection, and a reduction in production cost as well.

Furthermore, since the outer peripheral portion (second retaining member) of the base is of a removable type, grinding may be carried out with the grinding member kept strongly pressed on a workpiece to be ground when the outer peripheral portion rests in its position, while the grinding member may be brought into a soft touch with the workpiece in the absence of said outer peripheral portion. This may be most effective for the grinding of curved areas of workpieces.

A fourth embodiment of the present application provides the rotary grinding jig as defined in the third embodiment, characterized in that the second retaining member (11*b*) is retained by the central member (5) on the rear side thereof with the first retaining member (11*a*) combined therewith.

In the fourth embodiment, since the central member can support and maintain the second retaining member on its rear side, the second retaining member can be combined with the first retaining member without any specific engagement means provided between the first and second retaining members.

A fifth embodiment of the present application provides the rotary grinding jig as defined in any of the third and fourth embodiments characterized in that engaging portions such as projections (12*m*) are provided on one of the outer peripheral edge portion of the first retaining member (12*a*) and the inner peripheral edge portions such as grooves (12*n*) on the other one, so that both members may be removably engaged with each other by engagement means such as said engaging portions and said engaged portions, and said engagement means allow the second retaining member (12*b*) to cope with an axial force running from the surface side to the rear side.

In the fifth embodiment, the engagement means for the first and second retaining members precludes the necessity of support or maintenance by the central member of the second retaining member on its rear side.

A sixth embodiment of the present application provides the rotary grinding jig as defined in any of the first to fifth embodiments characterized in that a stopper means (35) that can play vertically is placed in a proper position of the central member (5) for preventing the retaining member (11) from turning in a direction in which the engagement of the retaining member (11) and the central member (5) is dissolved.

In the sixth embodiment, if the rotating shaft of the rotary drive has stopped, the retaining member turns in a direction in which the engagement of the retaining member and the central member is dissolved, but such a turning can be checked by the stopper means.

A seventh embodiment of the present application provides the rotary grinding jig as defined in any of the first to sixth embodiments, characterized in that when the retaining member (11) turns in a direction in which the engagement of the retaining member (11) and the central member (5) is dissolved, a dropout-preventive means is placed in a proper position of the retaining member (11) or the central member (5) for preventing the retaining member (11) (5) from falling from the central member (5) in the direction of the rotating shaft of the rotary drive.

In the seventh embodiment, if the rotary drive of a grinder has suddenly stopped, the retaining member will turn in a direction in which its engagement with the central member (5) is dissolved and then act so as to move in a direction (the direction of the rotating shaft of the rotary drive) in which it separates from the central member, said dropout-preventive means may avoid any possible separation and dropout of the retaining member from the central member in the direction of the rotating shaft of the rotary drive.

An eighth embodiment of the present application provides a rotary grinding jig comprising a disk-like base fixed to the rotary shaft of the rotary drive of a grinder and a grinding member (2) provided on the surface of said base, characterized in that the base is composed of a central member (8) positioned in the center thereof and an outer peripheral portion (9) positioned on the periphery thereof, that the outer peripheral portion (9) of the base is removably connected with the central member (8), and that a grinding operation may be continued by removing the outer peripheral portion (9) from the central member (8) according to the attrition of the grinding member (2).

In the eighth embodiment, as the outer peripheral portion of the base is designed to be removable from the central member, even if the grinding member provided on said peripheral portion has worn out entirely, the grinding operation can be continued by removing the outer peripheral portion from the central member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The preferred embodiments of the present invention will be described with reference to the accompanying drawings. FIGS. 1 to 21 show the embodiments of the present invention.

Figure 1:
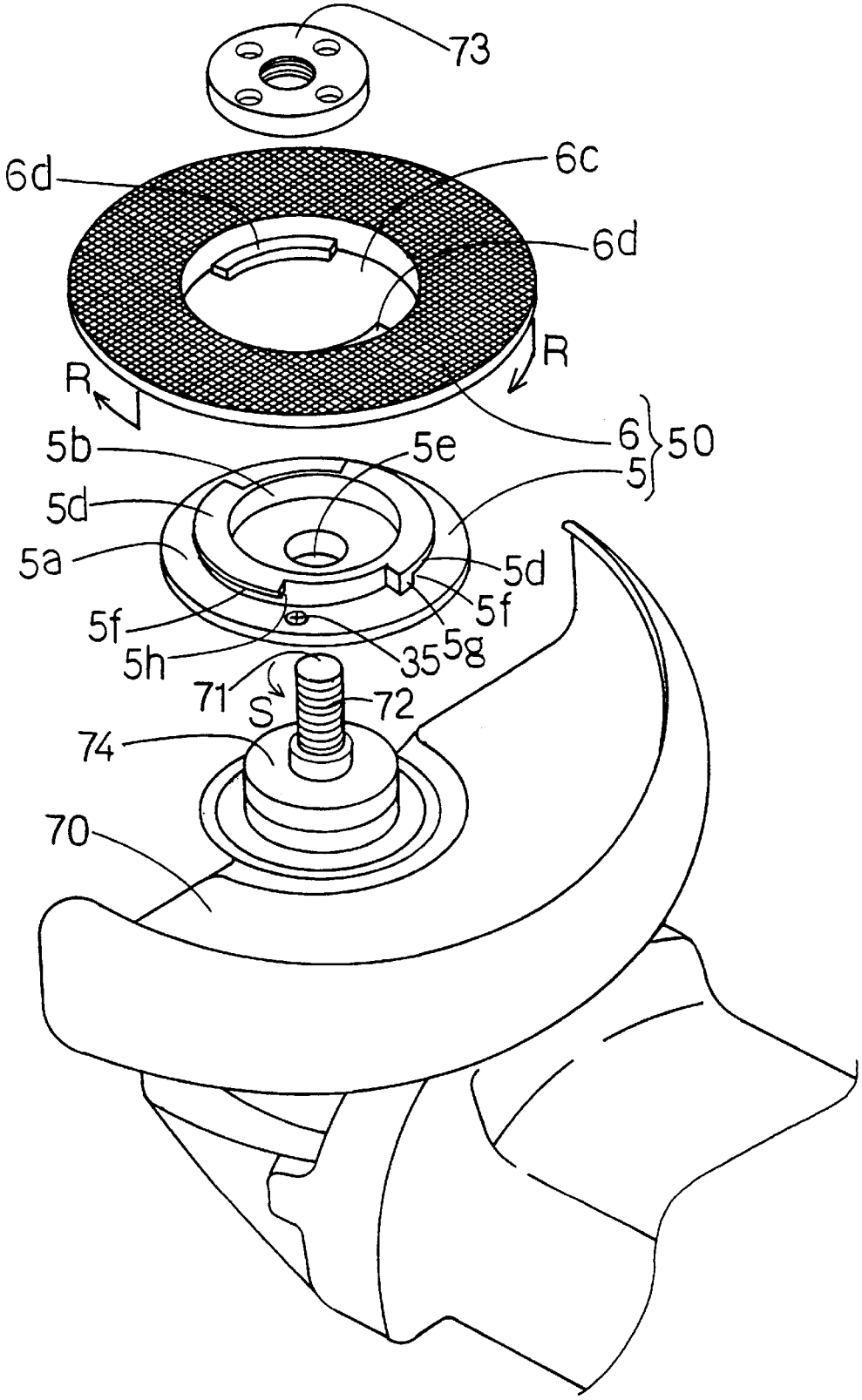
FIG. 1 is an exploded perspective view showing a first embodiment of the rotary grinding jig in accordance with the present invention.
Figure 2:
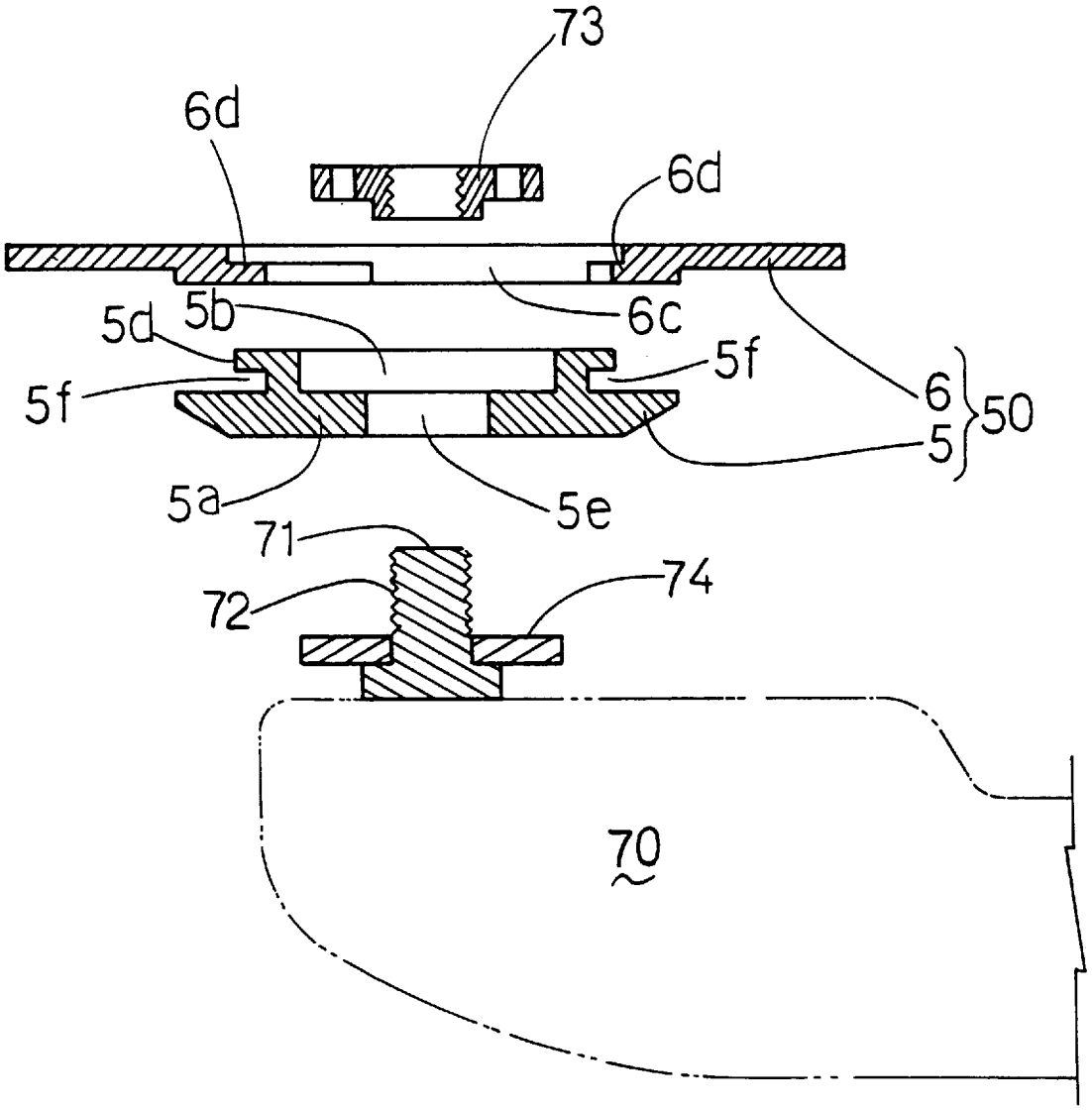
FIG. 2 is an exploded central longitudinal sectional view of the rotary grinding jig as shown in FIG. 1.
Figure 3:
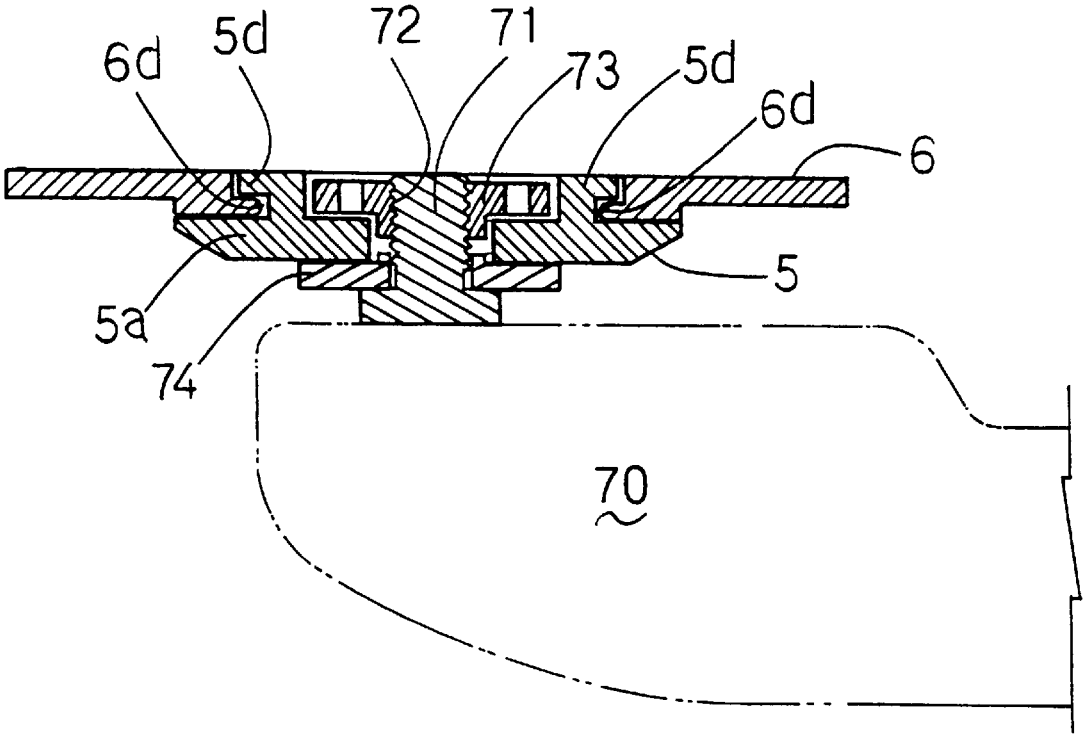
FIG. 3 is a central longitudinal sectional view showing the rotary grinding jig of FIG. 1 fixed to the rotating shaft of a rotary drive.

FIGS. 1 to 3 shown part of the rotating shaft of a grinder as a rotary drive and a first embodiment of a rotary grinding jig in accordance with the present invention, FIG. 1 being an exploded perspective view, FIG. 2 an exploded central longitudinal sectional view, and FIG. 3 a central longitudinal sectional view showing the rotary grinding jig firmly secured to the rotating shaft of the grinder.

A grinder 70 as illustrated is of an electrically driven type, having a rotating shaft 71 formed with a male thread 72 thereon.

A rotary grinding jig 50 comprises two separate members such as a central member 5 and a grinding member 6. The central member 5 is made of hard synthetic resin, and the grinding member 6 is produced by sintering a pressed mixture of synthetic resin, abrasive powders and particles.

Thus, the first embodiment has no retaining member for the grinding member intended to support the grinding member 6 from the back face as explained later. It is, of course, readily possible to provide a grinding member 6 bonded with a retaining member.

The numeral 73 designates a fixing screw for fitting on the male threaded portion 72 of the rotating shaft 71, and 74 a packing.

The central member 5 constituting the rotating grinding jig 50 comprises a disk 5*a,* a rotating shaft mounting hole 5*e* serving as a connector for the rotating shaft and formed in the center of the disk 5*a,* and a short engaging cylindrical portion 5*b* formed above the disk 5*a*. Said short engaging cylindrical portion 5*b* has, on its upper periphery, extensions 5*d* serving as a rotary engaging portion with a length equal to a quarter of the circumference and formed in two positions symmetrical about a point. The groove 5*f* will be formed in the lower part of the extension 5*d*. The grinding member 6 constituting another rotary grinding jig 50 is of a disk type, having a hollow portion 6*c* consisting of a circular through-hole formed in the middle part thereof. The hollow portion 6*c* has, on its lower inner periphery, ridges 6*d* serving as a rotary engaging portion with a length equal to a quarter of the circumference and formed in two positions symmetrical about a point.

Thus, the central member 5 and the grinding member 6 may be formed integral with each other by putting the groove 5*f* and the ridge 6*d* into rotative engagement with each other.

Specifically, the groove 5*f* formed in the central member 5 has a terminal portion 5*g* formed in one end thereof to provide a terminal end of the groove 5*f* and an opened introducing portion 5*h* in the other end of the groove 5*f*. The hollow portion 6*c* of the grinding member 6 is fitted onto the short engaging cylindrical portion 5*b* provided with the groove 5*f* until one end of each ridge 6*d* abuts on the terminal portion 5*g* of the groove 5*f,* as the one end of each ridge 6*d* is turned to engage with the opened introducing portion 5*h* of the groove 5*f* in the central member 5.

The direction R in which this fitting operation takes place is opposite to the direction S in which the rotating shaft 71 of the grinder 70 is turned. In this connection, when the rotating shaft 71 turns in the direction S for grinding operation, the grinding member 6 is loaded in a direction in which the grinding member 6 is tightened against the central member 5, whereby there is no risk of the grinding member 6 coming off its position.

The procedure steps for fixing the rotary grinding jig 50 on the rotating shaft 71 of the grinder 70 comprises inserting the rotating shaft mounting hole 5*e* of the central member 5 into the rotating shaft 71 with the packing 74 interposed between the central member and the rotating shaft, then fitting the fixing screw 73 onto the male screw 72 of the rotating shaft 71, and tightening the fixing screw 73 by means of a tool for locking purposes. Before starting this operation, the central member 5 and the grinding member 6 are joined together.

Alternatively, first the central member 5 may be mounted on the rotating shaft 71 with the packing 74 interposed between the latter, tightly secured by the fixing screw 73, and then the grinding member 6 may be mounted on the central member 5 in accordance with said engaging procedure.

If the grinding member 6 has entirely worn out after the rotary grinding jig 50 had been used for a grinding operation, the grinding member 6 can be simply removed out of the central member 5 by turning the grinding member 6 in a direction opposite to the direction R without the necessity of loosening the fixing screw 73 for further removal. Consequently, once the central member 5 has been mounted on the rotating shaft 71, it is unnecessary to carry out any subsequent removal of the fixing screw and fixing operation, and the grinding member 6 can be replaced by a new one with a simple operation.

The fixing screw 73 may be of an ordinary type, and can be tightly secured by tools such as a wrench.

In said preferred embodiment, a pin 35 as a stopper member is located near the introduction opening 5*h* of the groove 5*f* in the central member 5. This specific pin 35 will be described with reference to FIG. 4. It is designed to play by gravity in a vertical direction.

In the grinding operation, the pin 35 may protrude by its weight toward the grinding member 6. At a sudden stop of the grinder, the grinding member 6 will rotate in a direction in which it disengages from the central member 5, but such a rotation is blocked by the protruded pin 35, thereby avoiding displacement of the grinding member 6.

Figure 4A:
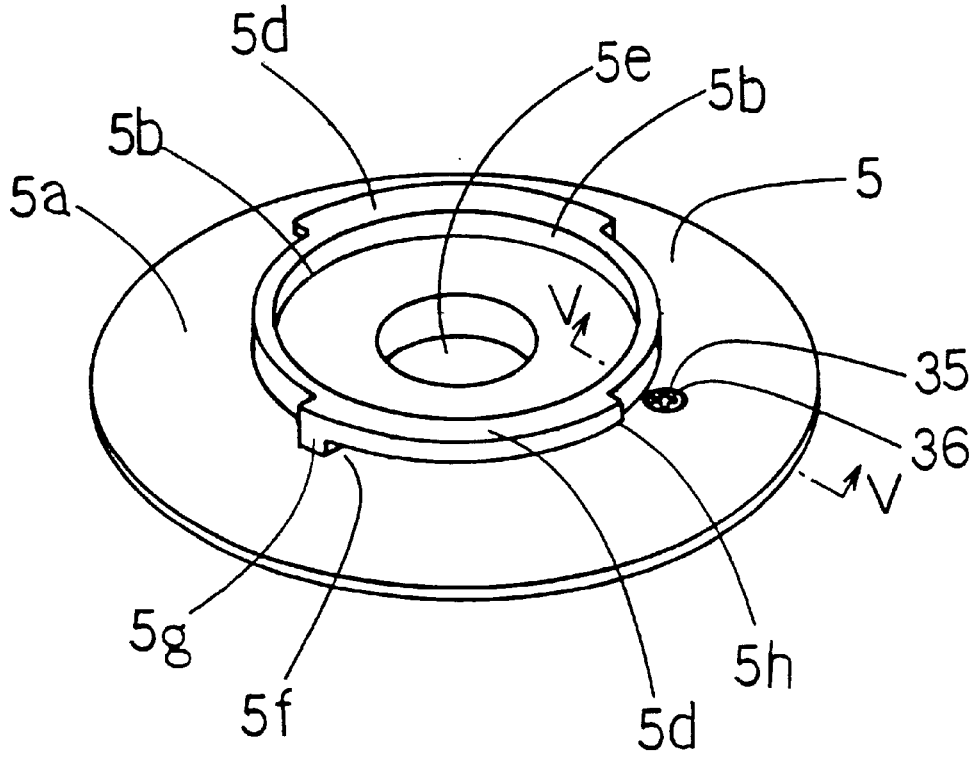
FIG. 4 shows the central member of the rotary grinding jig as shown in FIG. 1, (A) being an enlarged perspective view, and (B) a sectional view taken on V—V of FIG. 4(A)
Figure 4B:
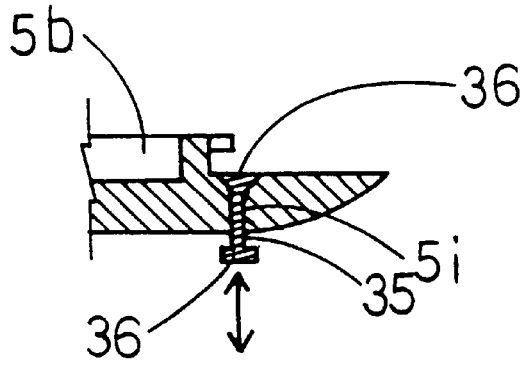

FIG. 4 illustrates the central member 5 which was used in the first preferred embodiment, (A) being an enlarged perspective view, and (B) a sectional view as taken on V—V of FIG. 4(A). As apparent from those views of drawings, there is provided the pin 35 as a stopper member in the vicinity of the introduction opening 5*h* of the groove 5*f*.

The pin 35 includes large-diameter heads 36, 36 formed in both ends thereof, and a shank having a length larger than that of a hole 5*i* opened in the disk 5*a,* by which hole the pin 35 is received with a play therebetween. Therefore, both large-diameter heads 36, 36 of the pin 35 tend to rise and fall under the influence of gravity. That is, in the drawing, the large-diameter head 36 of the pin 35 remains withdrawn with the short engaging cylindrical portion 5*b* facing upward, and when the rotary grinding jig is in action, the short engaging cylindrical portion 5*b* is put in a downward position so that the pin 35 protrudes downward.

When the grinding member is mounted with the short engaging cylindrical portion 5*b* of the central member 5 facing upward, the pin 35 is not hindrance to such a mounting operation because the pin is in retreat, and when in use, the pin 35 protrudes downward so as to act as a stopper to prevent the grinding member engaged with the central member 5 from turning for further disengagement.

The pin 35 may be replaced with a screw having no large-diameter heads on both ends. In that case, a hole to be opened in the central member 5 must have threads formed thereinside. After the grinding member has been engaged with the central member 5, the head of the screw is turned by a driver for loosening purposes to protrude the screw head from the disk 5*a* of the central member 5 to such a degree that the screw head may serve as a stopper.

The reason for the provision of such a stopper member is as follows. Usually, when the grinding operation is terminated and the power for the rotary drive is turned off, the rotating shaft does not stop its motion promptly but gradually reduces its number of revolutions until it completely stops. However, in the actual field of operation, often with impatience at waiting for subsequent grinder stop, operators try to bring the grinding member to a sudden stop by engaging the grinding members in touch with other member. In such a case, in the absence of the stopper, a force may act such that the grinding member and the central member will disengage from each other, and the grinding member may leave the central member. Therefore, in accordance with the present invention, in order to avert release of the grinding member from the central member, the pin 35 as a stopper member is provided in the central member 5 in case the grinding member should revolve in a direction in which it disengages from the central member.

Figure 5:
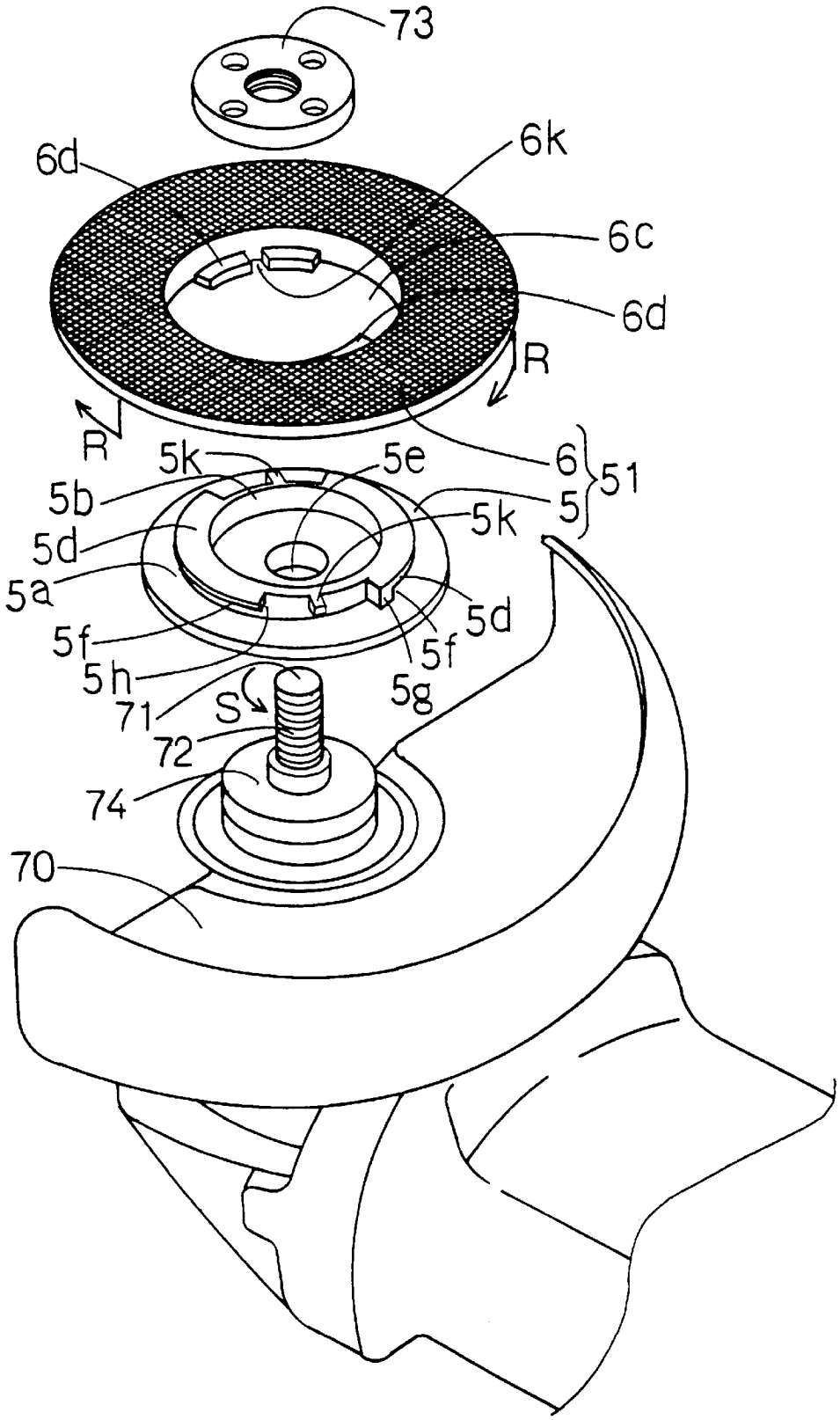
FIG. 5 is an exploded perspective view showing a second embodiment of the rotary grinding jig in accordance with the present invention.

FIG. 5 is an exploded perspective view showing part of the rotating shaft of a grinder as a rotary drive and a second embodiment of the rotary grinding jig in accordance with the present invention.

The illustrated grinder 70 is the same as that of the previous embodiment.

The rotary grinding jig 51 is substantially the same as that of said first embodiment except that it has no stopper pin and it is provided with a dropout-preventive means. The central member 5 constituting the rotary grinding jig 51 comprises a disk 5*a,* a rotating shaft mounting hole 5*e* serving as a connector for the rotating shaft and formed in the center of the disk 5*a,* and a short engaging cylindrical portion 5*b* formed above the disk 5*a*. Said short engaging cylindrical portion 5*b* has on its upper periphery extensions 5*d* serving as a rotary engaging portion with a length equal to a quarter of the circumference and formed in two positions symmetrical about a point. A long groove 5*f* is formed in the lower part of the extension 5*d*.

The groove 5*f* has a terminal portion 5*g* formed in one end thereof to provide a terminal end of the groove 5*f* and an opened introducing portion 5*h* in the other end of the groove 5*f*.

The grinding member 6 constituting another rotary grinding jig 51 is of a disk type, having a hollow portion 6*c* consisting of a circular through-hole formed in the middle part thereof. The hollow portion 6*c* has, on its lower inner periphery, ridges 6*d* serving as a rotative engaging portion with a length equal to a quarter of the circumference and formed in two positions symmetrical about a point.

Furthermore, in this preferred embodiment, the two ridges 6*d* each have a notch 6*k* formed substantially in the middle thereof, while locking projections 5*k* are respectively formed between the extensions 5*d,* 5*d* which are provided on the short engaging cylindrical portion 5*b* of the central member 5.

Each of the locking projections 5*k* provided on the central member 5 is a dropout-preventive means, which can prevent the grinding member 6 from dropping out of the central member 5 axially of the rotating shaft.

The procedure steps of making an engagement between the grinding member 6 and the central member 5 comprises aligning the notches 6*k* of the ridges 6*d* of the grinding member 6 with the position of the locking projections 5*k* of the central member 5, fitting a hollow portion 6*c* of the grinding member 6 onto the short engaging cylindrical portion 5*b* of the central member 5, and engaging one end of the ridges 6*d* into the introducing portion 5*h* of the groove 5*f* in the central member 5 as the ridge 6*d* is gradually turned in the direction R together with the disk 5*a* abutting the ridge 6*d* until the ridge 6*d* gets in touch with the terminal portion 5*g* of the groove 5*f*.

If the grinder stops with the grinding jig kept in touch with an object to be ground, the grinding member 6 may turn in a direction (as opposed to the direction R) in which disengagement takes place. In that case, said locking projections 5*k* as dropout-preventive means is operable to prevent the grinding member 6 from separating from the central member 5 axially of the rotating shaft 71 of the grinder by the arrangement such that the end of the ridge 6*d* is abutted against the terminal portion 5*g* of the other groove 5*f* to put the notch 6*k* and the locking projection 5*k* in separate positions. This will be further specified afterwards.

The described number of the extensions 5*d* and locking projections 5*k* being provided on the central member 5 and the described numbers of the ridges 6*d* and notches 6*k* being provided on the grinding member 6 are by way of example, and any number may freely be selected.

The procedure for fixing the rotary grinding jig 51 on the rotating shaft 71 of the grinder 70 is the same as in the above-mentioned embodiment.

If the grinding member 6 has entirely worn out after the rotary grinding jig 51 has been used for a grinding operation, the grinding member 6 can be simply removed out of the central member 5 by turning the grinding member 6 in a direction opposite to the direction R for rotative engagement without the necessity of loosening the fixing screw 73 for further removal so as to put the notches 6*k* in the position of the locking projections 5*k*.

Consequently, once the central member 5 has been mounted on the rotating shaft 71, it is unnecessary to carry out any subsequent removal of the fixing screw and fixing operation, and the grinding member 6 can be exchanged for a new one with a simple operation.

Figure 6:
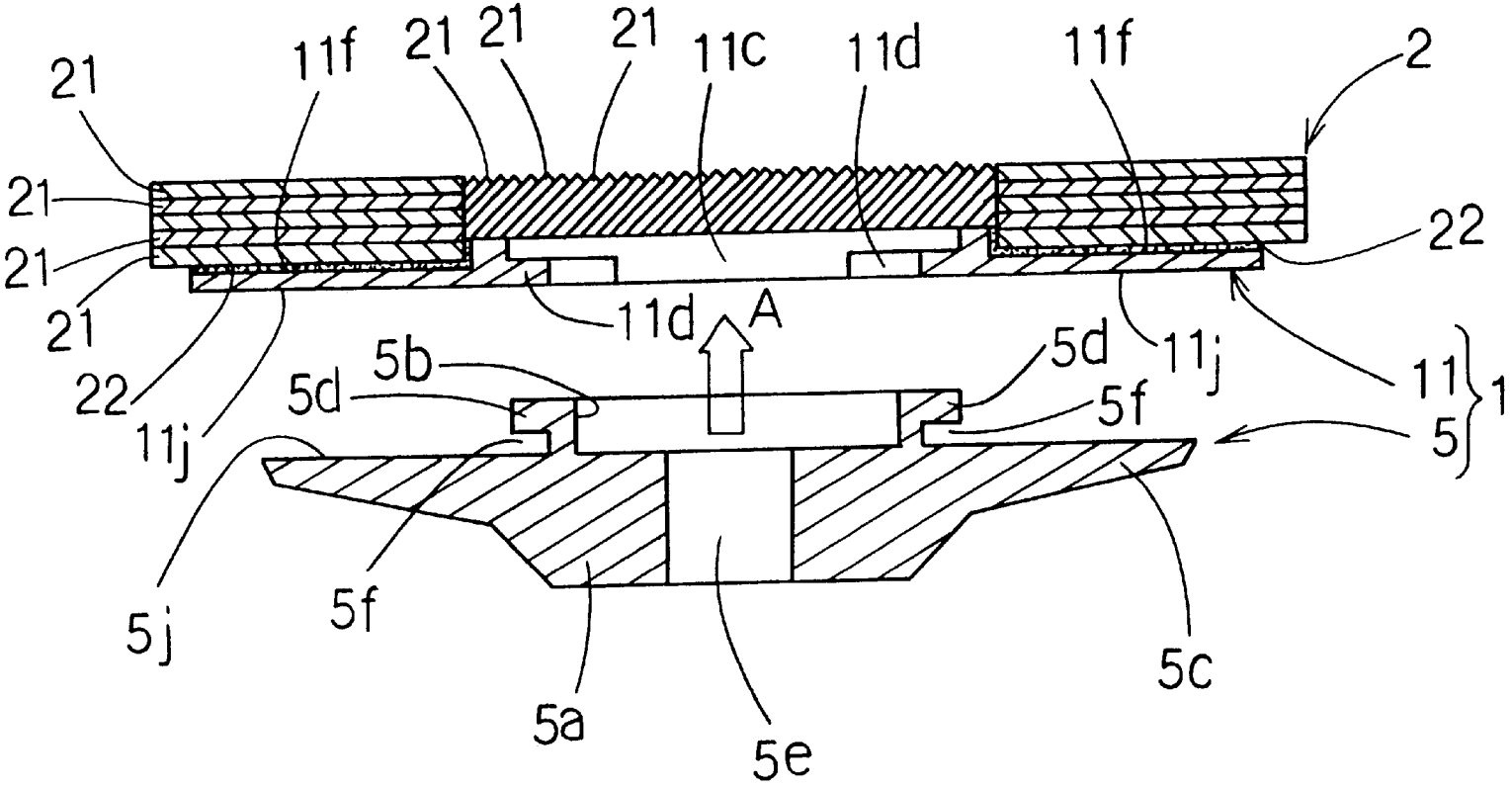
FIG. 6 is an exploded central longitudinal sectional view showing a third embodiment of the rotary grinding jig in accordance with the present invention.
Figure 7:
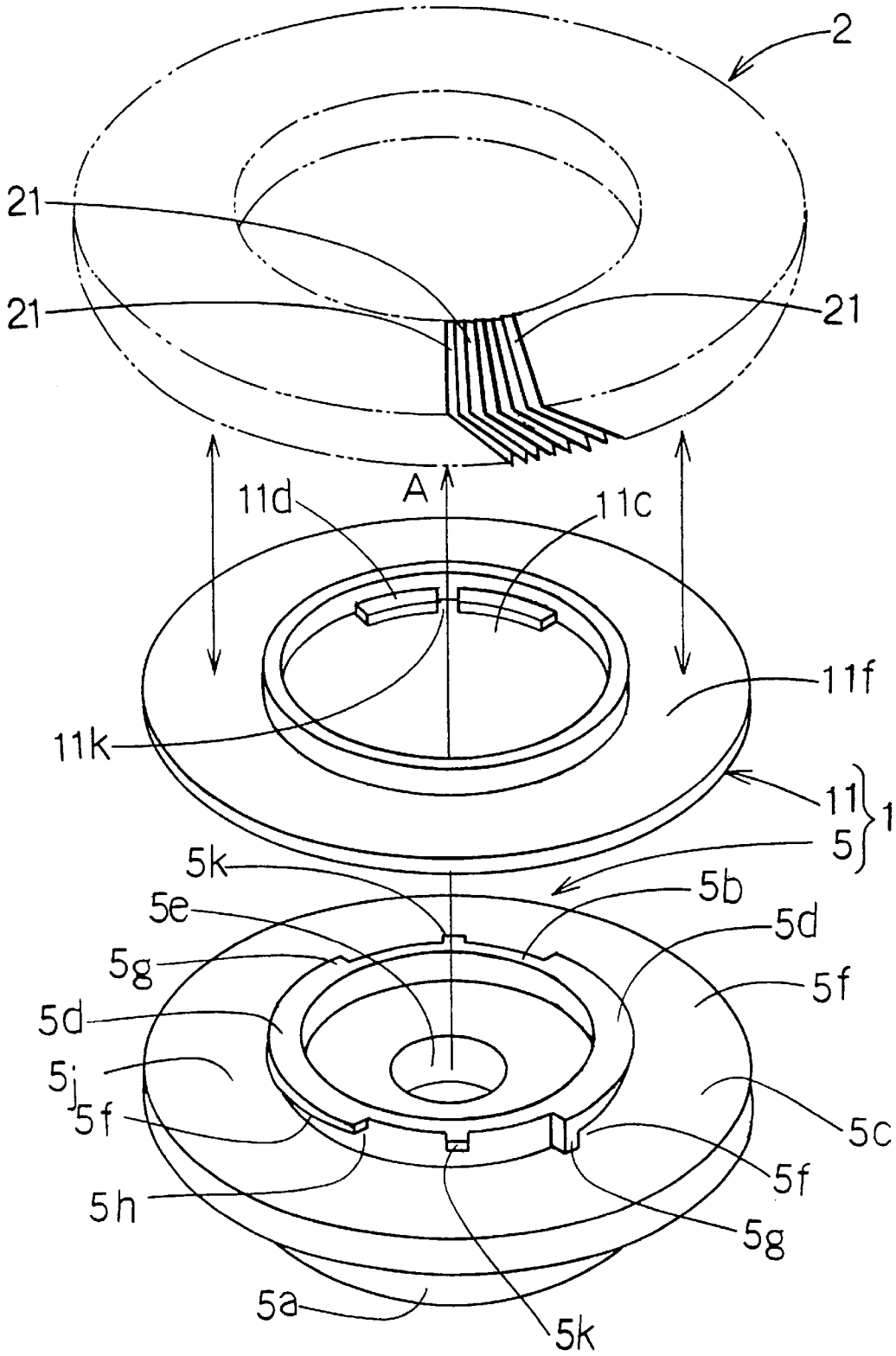
FIG. 7 is an exploded perspective view explanatory of the rotary grinding jig as shown in FIG. 6.

FIGS. 6 and 7 illustrate a third preferred embodiment in accordance with the present invention, FIG. 6 being a substantially central longitudinal sectional view showing a retaining member 11 for a grinding member to which a grinding member 2 is attached, and a central member 5, which members being in separate positions, and FIG. 7 an exploded perspective view explanatory of the retaining member 11, the grinding member 2 unattached to the former, and the central member 5.

Unlike in the previous embodiment, a base 1 is constituted by the retaining member 11 and the central member 5, both the components being made of hard resin.

The retaining member 11 is of a disk type, including a hollow portion 11*c* consisting of a circular through-hole. The retaining member 11 has the grinding member 2 bonded by an adhesive 22 to the surface 11*f* thereof.

The grinding member 2 consists of a plurality of grinding cloths 21 . . . 21. Each of the grinding cloths 21 . . . 21 is a small segment of a substantially rectangular or fan-like shape. The grinding cloth so called here includes cloth smeared with abrasive powders as well as paper daubed with abrasive powders. The cloths 21 are adhesively arranged in a radial pattern on the retaining member 11 in a manner such that adjacent grinding cloths lean against each other, namely they lean toward the surface of the retaining member 11.

More specifically, the grinding cloths 21 are adhesively attached to the surface 11*f* of the retaining member 11 coated with adhesive 22 so that they will overlap with each other with a tubular or radial arrangement. Pressure is applied to the grinding cloths, while the adhesive 22 is dried.

The hollow portion 11*c* of the retaining member 11 has, on its inner periphery, ridges 11*d* serving as a rotary engaging portion with a length substantially equal to a quarter of the circumference and formed in tow positions symmetrical about a point. This arrangement of ridge 11*d* is the same as that of the ridge 6*d* provided on the grinding member 6 in the second embodiment, the ridges 11*d* each having a notch 11*k* formed substantially in the middle thereof.

The central member 5 is substantially the same as the counterpart in the second embodiment, including a disk 5*a,* a short engaging cylindrical portion 5*b* provided on the disk 5*a,* and a flange-like portion 5*c* laterally extending from the side edge.

The disk 5*a* has an outer diameter that is smaller than that of the retaining member 11 but larger than the inner diameter of the hollow portion 11*c* of the retaining member 11.

The disk 5*a* has a rotating shaft mounting hole 5*e* formed in the center thereof so as to serve as a connector to connect with the rotating shaft of the rotary drive. The rotating shaft mounting hole 5*e* is a circular hole extending through the disk 5*a* and having an inner diameter substantially equal to the outer diameter of the rotating shaft (not shown) of the rotary drive. The disk 5*a* may be firmly secured to said rotating shaft by fitting and securely mounting the rotating shaft mounting hole 5*e* on the rotating shaft by a fixing means, as illustrated in the second embodiment.

The short engaging cylindrical portion 5*b* is of a substantially cylindrical type, concentric with the disk 5*a,* and having a groove 5*f* formed on the outer periphery thereof to serve as a rotary engaging portion for engaging with the ridge 11*d* formed in the hollow portion 11*d* of the retaining member 11.

The arrangement of the groove 5*f* is the same as that in the second embodiment. The short engaging cylindrical portion 5*b* has, on its upper outer periphery, extensions 5*d* having a length substantially equal to a quarter of the peripheral length and formed symmetrically on two points. The long groove 5*f* is formed in the lower part of the extension 5*d,* having a terminal portion 5*g* formed in one end thereof to provide a terminal end of the groove 5*f* and an opened introducing portion 5*h* in the other end thereof.

There is provided a locking projection 5*k* between the extensions 5*d.* The locking projection 5*k* may act as a dropout-preventive means, so that it can prevent the retaining member 11 from dropping from the central member 5, as in the second embodiment.

The flange-like portion 5*c* is equal to or smaller than the retaining member 11 in outer diameter.

The engaging of the central member 5 with said retaining member 11 is achieved in the same manner as that of the second embodiment.

The above-described arrangement makes it possible to mount or dismount said retaining member 11 on or from the central member 5 as it remains firmly fixed to the rotating shaft of the rotary drive. Therefore, if the grinding member 2 has worn out entirely, the retaining member 11 can be simply exchanged for another one provided with a new grinding member 2.

With the central member 5 and the retaining member 11 remaining engaged with each other, the flange-like portion 5*c* is abutted by its surface 5*j* on the rear side 11*j* of the retaining member 11. This may push back a force applied from the grinding member 2 backward, whereby the shape of the grinding member 2 can be safely maintained in the grinding operation. Thus, thanks to the existence of the flange-like portion 5*c,* the retaining member 11 which is destined to be thrown away together with the grinding member 2 may be made thinner.

The bonding between the central member 5 and the retaining member 11 can be strengthened by increasing the frictional resistance between both members by rendering the surface 5*j* of the flange-like portion 5*c* of the central member 5, or the rear side of the retaining member 11 or both properly raised and depressed.

Figure 8A:
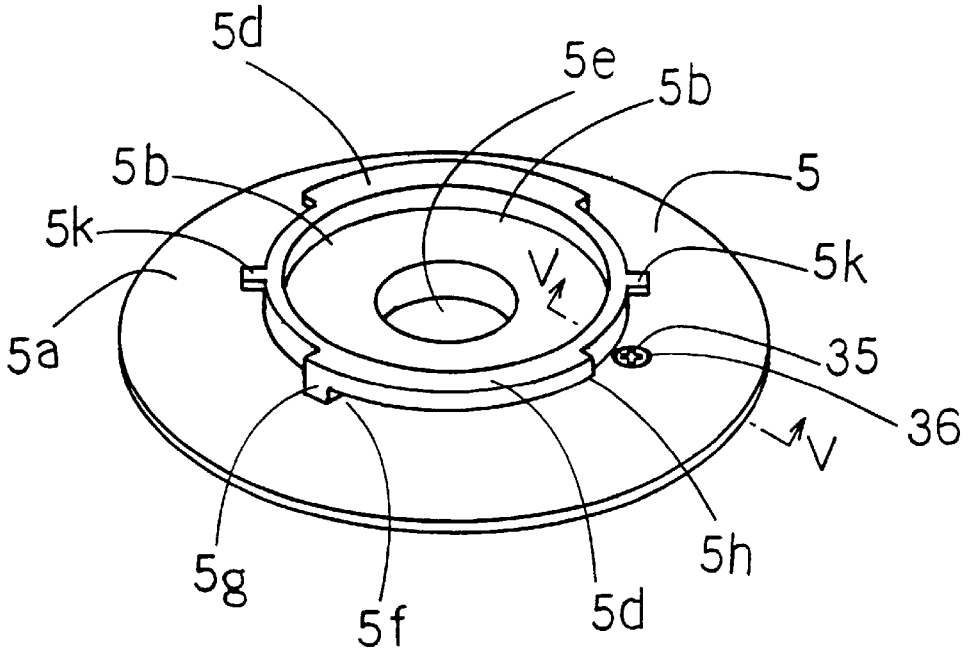
FIG. 8 shows another embodiment of the central member of the rotary grinding jig in accordance with the present invention (A) being an enlarged perspective view, and (B) a sectional view taken on V—V of FIG. 8 (A)
Figure 8B:
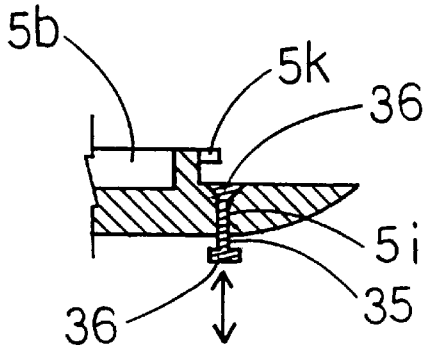

FIG. 8 shows the central member 5 used in the second and third embodiments and having an additional stopper member, (A) being an enlarged perspective view, and (B) a sectional view taken on V—V of (A).

As apparent from the drawing, there is provided a pin 35 near the introducing portion 5*h* of the groove 5*f.* This pin 35 serves as a stopper member. The pin 35, which is the same one as shown in the first embodiment, has large-diameter heads 36, 36 formed in both ends thereof, a shank with a length larger than the length of a hole 5*i* opened in the disk 5*a,* by which hole the pin 35 is received with a play therebetween. Therefore, both large-diameter heads 36, 36 of the pin 35 tend to rise and fall under the influence of gravity. That is, in the drawing, the large-diameter head 36 of the pin 35 remains withdrawn with the short engaging cylindrical portion 5*b* facing upward, and when the rotary grinding jig is in action, the short engaging cylindrical portion 5*b* faces downward (i.e. the grinding member faces downward) so that the pin 35 protrudes downward.

When the grinding member is rotationally mounted with the short engaging cylindrical portion 5*b* of the central member 5 facing upward, the pin 35 is not a hindrance to such a mounting operation because the pin is in retreat, and when in use (as with the grinding member facing downward), the pin 35 protrudes downward so that either the grinding member 6 engaged with the central member 5 or the retaining member 11 can be prevented from turning in a direction in which any of the members will be displaced.

A screw may be substituted for this pin 35, as in the first embodiment.

By employing such a stopper, the grinding member 6 or the retaining member 11 can be prevented from turning in the direction of disengagement even if the rotating shaft has made a sudden stop.

In this embodiment, the locking projections 5*k* serving as a dropout-preventive means may avoid any dropout of the grinding member 6 or the retaining member 11 in an axial direction of the rotating shaft of the grinder.

Accordingly, in the embodiment as shown in FIG. 8, the combination of the dropout-preventive means and the stopper member may perform a double stopper function.

Figure 9A:
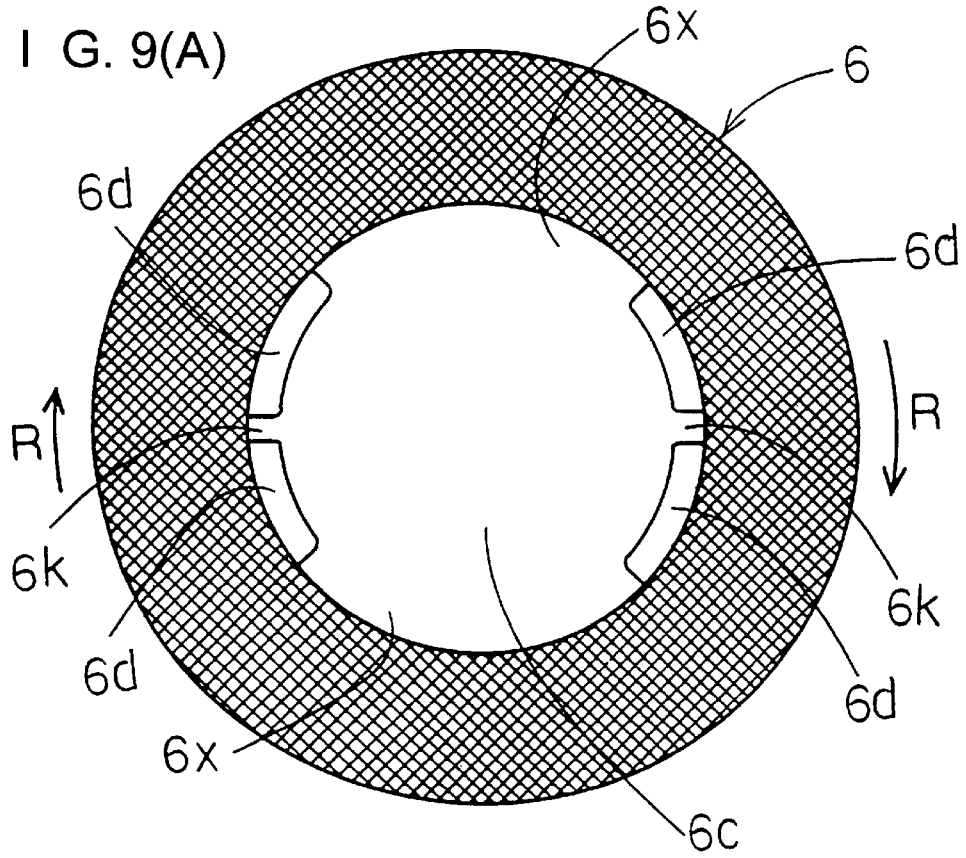
FIG. 9 shows the rotary grinding jig of the second embodiment in accordance with the present invention, (A) being a plan view of a grinding member, and (B) a plan view of a central member.
Figure 9B:
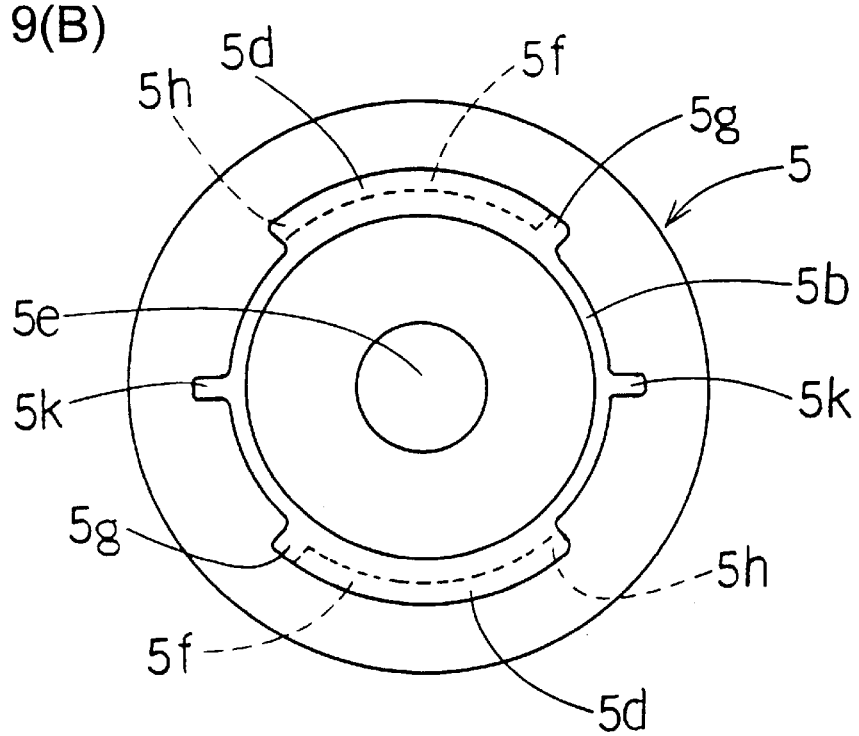

FIGS. 9 and 10 illustrate the relation between the locking projection 5*k* and the notch 6*k* in the second embodiment. FIG. 9(A) is a plan view of grinding member 6 and FIG. 9(B) is a plan view of the central member 5.

As already explained, on the inner periphery of the hollow portion 6*c* consisting of a through-hole in the middle of the grinding member 6, two ridges 6*d* each protruding centrally of said hole and having a length equal to a quarter of the circumference are disposed respectively in the positions symmetrical about a point. Each ridge 6*d* has a notch 6*k* formed in the middle thereof.

On the other hand, the short engaging cylindrical portion 5*b* of the central member 5 has extensions 5*d* extending from the upper edge outward, and a groove 5*f* is formed in the lower part of the extension 5*d,* having an introducing portion 5*h* in one end thereof and a terminal portion 5*g* in the other end. The extensions 5*d,* each having a length equal to a quarter of the circumference, are also provided in tow positions symmetrical about a point. The respective locking projections 5*k,* serving as dropout-preventive means, are provided between the respective extensions 5*d.*

Figure 10A:
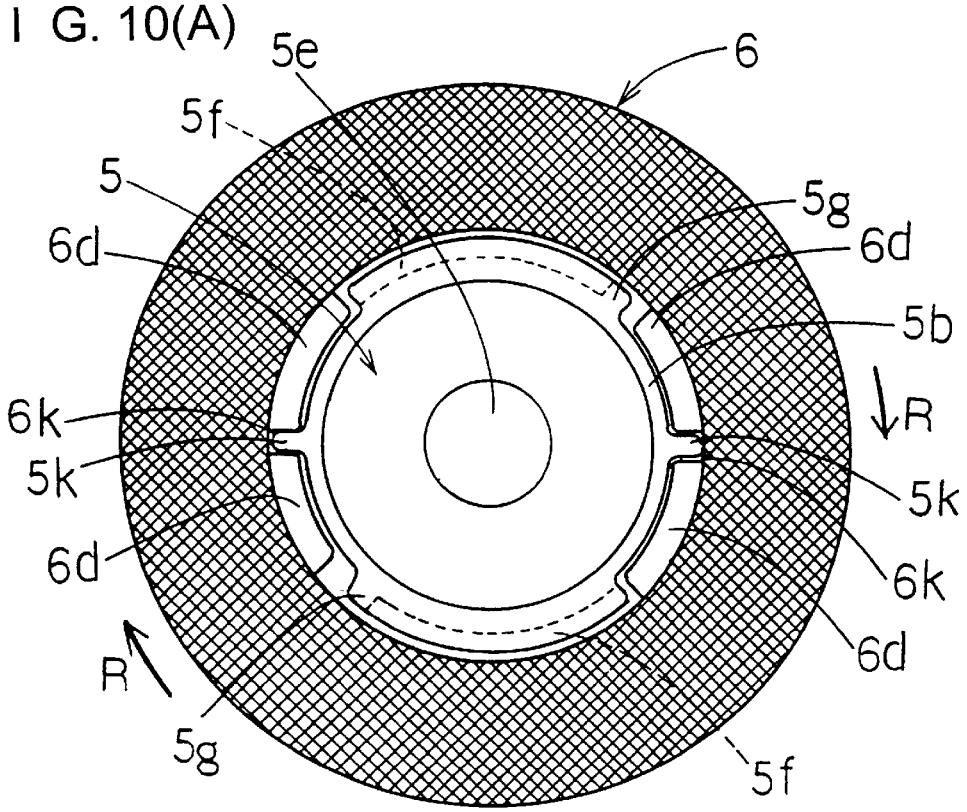
FIG. 10 is a plan view showing the engaging relationship between the grinding member and the central member as shown in FIG. 9, (A) shows the engaging action at work, and (B) shows the state in which a prevention is taken against the dissolution of the engagement of both members.

FIG. 10(A) is a plan view showing the combination of the hollow portion 6*c* formed in the middle of the grinding member 6 and the short engaging cylindrical portion 5*b* of the central member 5.

As apparent from this drawing, the hollow portion 6*c* of the grinding member 6 may be combined with the short engaging cylindrical portion 5*b* of the central member 5 by fitting the locking projections 5*k* of the central member 5 into the notches 6*k* of the grinding member 6.

Then, by turning the grinding member 6 in the direction of arrow R, the ridges 6*d* are gradually inserted into the grooves 5*f* of the central member 5 until the former get in contact with the terminal portions 5*g* of the grooves 5*f*, thus resulting in the complete engagement of the grinding member 6 in the central member 5.

Figure 10B:
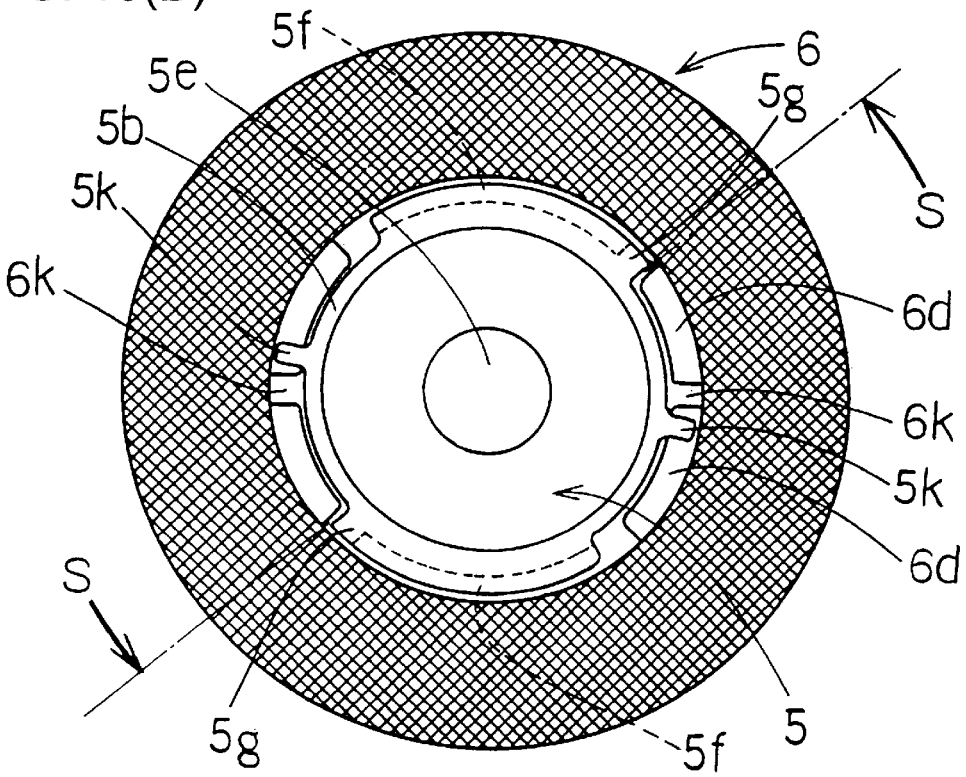

FIG. 10(B) is an explanatory view showing the state in which the ridges 6*d* of the grinding member 6 and the grooves 5*f* of the central member 5 disengage from each other in the event that in operation, a sudden stop of the rotary drive due to a power cut has been made while the grinding member and the object being ground are kept in contact with each other.

In the grinding operation, the rotary grinding jig in accordance with the present invention is driven by the rotary drive to turn in the direction of arrow S, and if the rotary drive suddenly stops, the grinding member 6 only continues turning relatively in the direction of arrow S in accordance with the law of inertia. That is, the grinding member 6 only rotates in a direction (the direction of arrow S) in which the engagement with the central member 5 is dissolved. The grinding member 6 stops its rotary motion just when one end of the ridge 6*d* collides against the terminal portion 5*g* of one groove 5*f* after the ridge 6*d* has separated from the other groove 5*f*. In this case, the terminal portion 5*g* acts as a rotation stopping portion to discontinue the rotation of the ridge 6*d*. FIG. 10(B) illustrates this matter.

Positioning of the notches 6*k* of the grinding member 6 and the locking projections 5*k* of the central member 5 is carried out in advance such that these components may get slightly out of position with each other in the described situation. Such a positional relation enables the locking projections 5*k* to function as a dropout-preventive means.

In order that the grinding member 6 and the central member 5 are engaged with each other, preliminary positioning of both members is achieved so that the notches 6*k* may meet with the locking projections 5*k* for such further engagement.

Generally speaking, said preliminary procedure is intended for the arrangement such that the locking projections 5*k* and the notches 6*k* may meet each other in position before the ends of the ridges 6*d* of the grinding member 6 are abutted against the terminal portion 5*g* of the central member 5 serving as a rotation stopping portion by means of the grinding member 6 which turns in the direction in which the engagement with the central member 5 is dissolved, in case the grinder has stopped during the grinding operation.

The provision of the notches 6*k* and the locking projections 5*k* as dropout-preventive means allows avoidance of separation or dropout of the grinding member of the grinding jig or the retaining member from the central member if the rotary grinding jig is handled as it stands facing upward or in an upright position.

Furthermore, the addition of said pin 35 as a stopper member may realize a double stopper function, so that even though the rotary grinding jig in accordance with the present invention faces in whatever direction when in use, namely downward, upward, or upright, there is no risk of the grinding member or the retaining member separating or dropping out of the central member.

The arrangement of the notches 6*k* and the locking projections 5*k* may be properly changed in design.

For example, said separation or dropout can also be avoided without notches 6*k* provided on the ridges 6*d* of the grinding member 6. In that case, the ridge 6*d* is made about half as long as the described embodiment, and the locking projection 5*k* is made extending in the peripheral direction of the short engaging cylindrical portion 5*b* of the central member 5. Such a structure may cause the ridge 6*d* to take up its position under the locking projection 5*k* when the ridge 6*d* is in contact with the terminal portion 5*g* of one groove 5*f* serving as a rotation stopping portion after the disengagement from the other groove 5*f* of the central member 5. This enables the grinding member 6 to escape dropout from the central member 5.

That is to say, the ridge 6*d* may be designed such that it stops in a position under the locking projection 5*k* of the central member 5 after the central member 5 has disengaged from the groove 5*f*. This may enable the locking projection 5*k* to discharge its function as a dropout-preventive means.

Referring to FIG. 9, projections may be provided in the positions of the notches 6*k* of the ridges 6*d* of the grinding member 6 instead of both the locking projections 5*k* and notches 6*k*, while with the exclusion of the terminal portions 5*g* from the extensions 5*d* of the central member 5 only grooves 5*f* remain under the extensions 5*d*.

In such a case, the engagement of the grinding member 6 and the central member 5 may be achieved by putting notches 6*x*, 6*x* between the ridges 6*d* of the grinding member 6 and the extensions 5*d*, 5*d* of the central member 5 together to combine both members, then turning them in the direction R, and abutting said projections, as rotation stopping portion, of the ridges 6*d* of the grinding member 6 against the end of the extensions 5*d*.

If the grinder stops in operation, the grinding member 6 turns in the direction (opposite to the direction R) in which the engagement with the central member 5 is dissolved, and the ridge 6*d* disengages from one extension 5*d*, and engages with the other extension 5*d* in turn so that the projection formed in the substantially middle part of the ridge 6*d* for serving rotation stopping portion may abut against the end portion of this extension 5*d*, with the result that this extension 5*d* can discharge its function as a dropout-preventive means.

Figure 11:
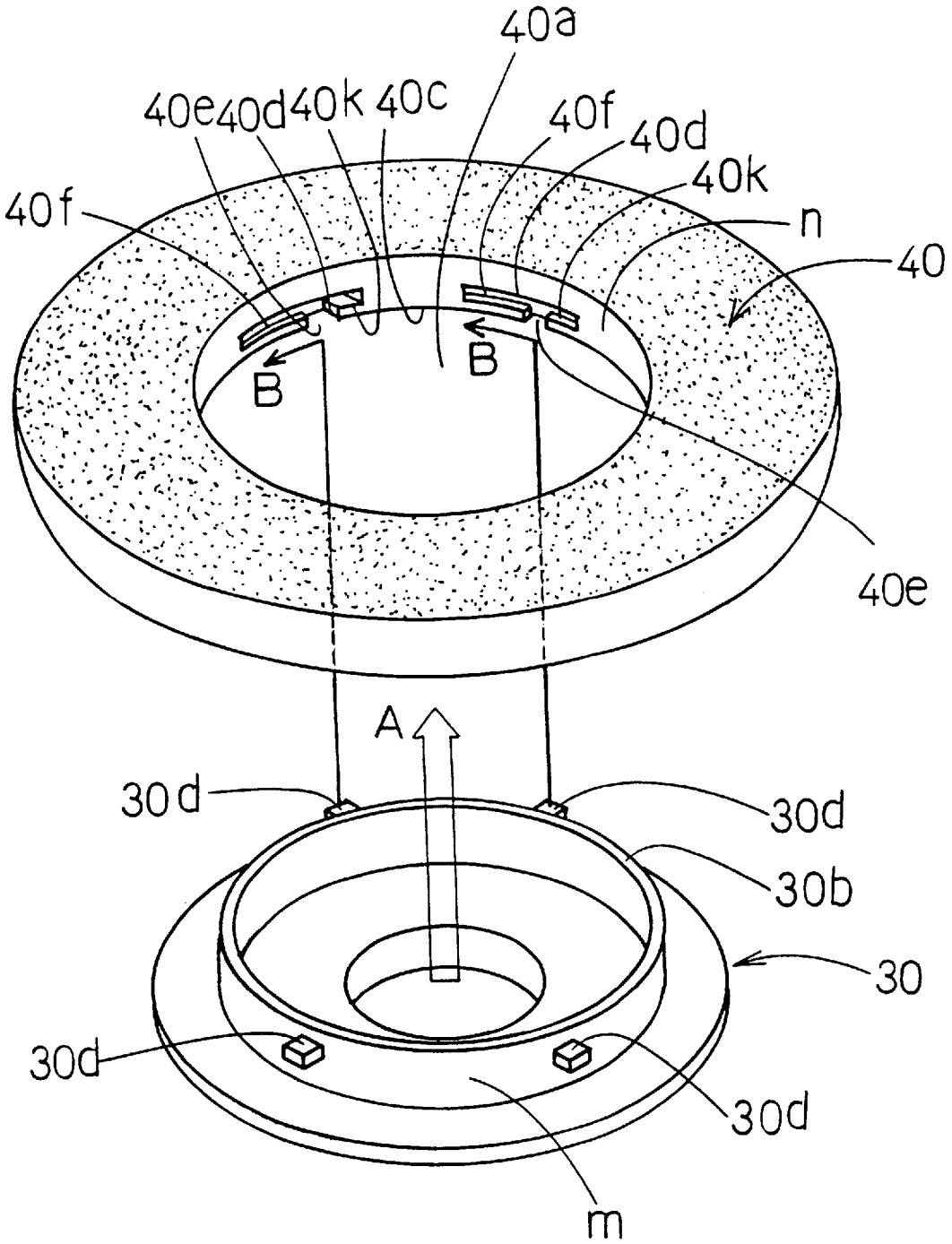
FIG. 11 is an exploded perspective view explanatory of a fourth embodiment of the rotary grinding jig in accordance with the present invention.

FIG. 11 is an exploded perspective view showing a fourth embodiment of the present invention.

Also in this embodiment, the base does not possess any retaining member for the grinding member, and represents a central member 30.

As shown in this drawing, a short engaging cylindrical portion 30*b* of the central member 30 includes four projections 30*d* spaced on the outer periphery m for serving as rotative engagement portions instead of the grooves in the previous embodiments.

On the other hand, there are formed four receiving grooves 40*d* which are similarly spaced on the inner periphery n of the hollow portion 40*a* constituted by a circular through-hole in a grinding member 40. The receiving grooves 40*d* are disposed in the positions to which they have retreated from the rear side 4*c* along the direction of insertion A and opened in the peripheral direction of the inner periphery n. These receiving grooves 40 each are rotative engagement portions.

Each receiving groove 40*d* has an introducing portion 40*e* extending in the direction of insertion A, and a retaining portion 40*f* extending in the peripheral direction B of the inner periphery n of the hollow portion 40*a*.

The combination of the grinding member 40 with the central member 30 is conducted by the following steps: the hollow portion 40*a* of the grinding member 40 is inserted into the short engaging cylindrical portions 30*b* by plugging the projections 30*d* . . . 30*d* from the rear side 40*c* of the grinding member 40 into the introducing portions 40*e* . . .

40*e* of the receiving grooves 40*d* . . . 40*d*. Furthermore, in order to insert the projections 30*d* . . . 30*d* into the retaining portion 40*f* . . . 40*f* of the receiving grooves 40*d* . . . 40*d*, either the central member 30 is turned peripherally relative to the grinding member 40, or the grinding member 40 is turned peripherally relative to the central member 30, whereby the projections 30*d* are turned relatively in said peripheral direction B until the projections 30*d* are engaged in the receiving grooves 40*d* to such an extent that the projections 30*d* get in touch with the end of the retaining portions 40*f*.

The engagement process for the central member 30 and the grinding member 40 has been completed as in the above-described manner. The disengagement of the grinding member 40 from the central member 30 may be done in the procedure reverse to the above.

Additionally, in this embodiment, each of the receiving grooves 40*d* of the grinding member 40 includes a locking groove 40*k* formed peripherally opposite to the retaining portion 40*f* and extending from the introducing portion 40*e*. Such a locking groove 40*k* may act as a dropout-preventive means to prevent the grinding member 40 from slipping out of the central member 30.

The function of the locking grooves 40*k* as dropout-preventive means is as follows. For example, if the rotary drive happened to stop its motion in the grinding operation, the grinding member 40 turns in the direction (opposite to the illustrated direction of arrow B) in which the engagement with the central member 30 is released. Then, the projections 30*d* of the central member 30 each run from the retaining portions 40*f* of the receiving grooves 40*d* and past the introducing portions 40*e* into contact with the terminal ends (rotation stopping portion) of the locking grooves 40*k*. In said contact, the projections 30*d* and the introducing portions 4*e* of the receiving grooves 40*d* do not meet each other, so that the projections 30*d* may be prevented from falling from the introducing portions 402.

The peripheral length of the locking groove 40*k* serving as dropout-preventive means may be set in a proper manner.

There are provided four projections 30*d* and receiving grooves 40*d* respectively in this embodiment, but this number may be properly changed. The retaining portion 40*f* of the receiving groove 40*d* may be made gradually narrower in width, or a tiny projection may be provided inside the retaining portion 40*f* for serving as slippage-preventive means to ensure that the projections 30*d* will be maintained within the retaining portion 40*f*.

Many different types of dropout-preventive means have been described. All they have to do is have an arrangement based on the following structure. A ridge or projection is provided in any one of the inner periphery of the grinding member or the hollow portion of the retaining member and the outer periphery of the short engaging cylindrical portion of the central member, and grooves in the other one so as to enable the rotative engagement of both members. If the grinding member turns in the direction of disengagement opposite to that of rotative engagement, and the ridge provided in said inner periphery or outer periphery abuts against the rotation stopping portion, the ridges and the notches do not get into positional agreement with each other to avoid any dropout of the grinding member or the retaining member when some of them have disengaged from the central member.

The concrete means for preventing dropout is the combination of said notch 6*k* and locking projection 5*k* (the first to third embodiments), and the combination of said projection 30*d* and locking groove 40*k* (the fourth embodiment). Other dropout-preventive means can be embodied by said notches 6*x* and extensions 5*d* (with no terminal portion), and an additional rotation stopping portion placed in a suitable position.

Four preferred embodiments in accordance with the present invention have been described so far. In the present invention, the rotary grinding jig consists of three components such as the central member, the retaining member, and the grinding member. Of all the members, the retaining member and the grinding member may be formed integral with each other, or the retaining member and the central member may be formed integral with each other. In short, it is preferable that the retaining member and the grinding member, or only the grinding member be removably attached to the central member.

For this purpose, the maximum outer diameter of the fixing means such as a fixing screw for securing the central member to the rotational shaft of the rotary drive must be smaller than the inner diameter of the through-hole (hollow portion) formed in the middle of the removable retaining member or the grinding member. This makes it possible for the retaining member or the grinding member to be removed from the central member as the latter remains fixed to the rotational shaft.

Examples of other removable fixing means than can be employed are various kinds of mechanical engagement means such as the rotative engagement of ridges and grooves, the rotative engagement of projections and receiving grooves, etc.

The rotative engagement portion provided on the inner edge of the through-hole (hollow portion) of the grinding member or retaining member may not always be disposed in a site of the inner edge but on a part of the joint area for the central member near the inner edge.

In accordance with the present invention, there are provided an additional stopper member and dropout-preventive means to avoid any possible separation or disengagement of the central member, and the grinding member or the retaining member from each other when the rotative engagement of both members takes place. The stopper member is adapted to prevent the grinding member or the retaining member from turning in the direction of disengagement on the plane normal to the direction of the rotational shaft, while the dropout-preventive means acts to prevent the grinding member or the retaining member from separating from the central member in a direction in which the rotational shaft extends.

Figure 12:
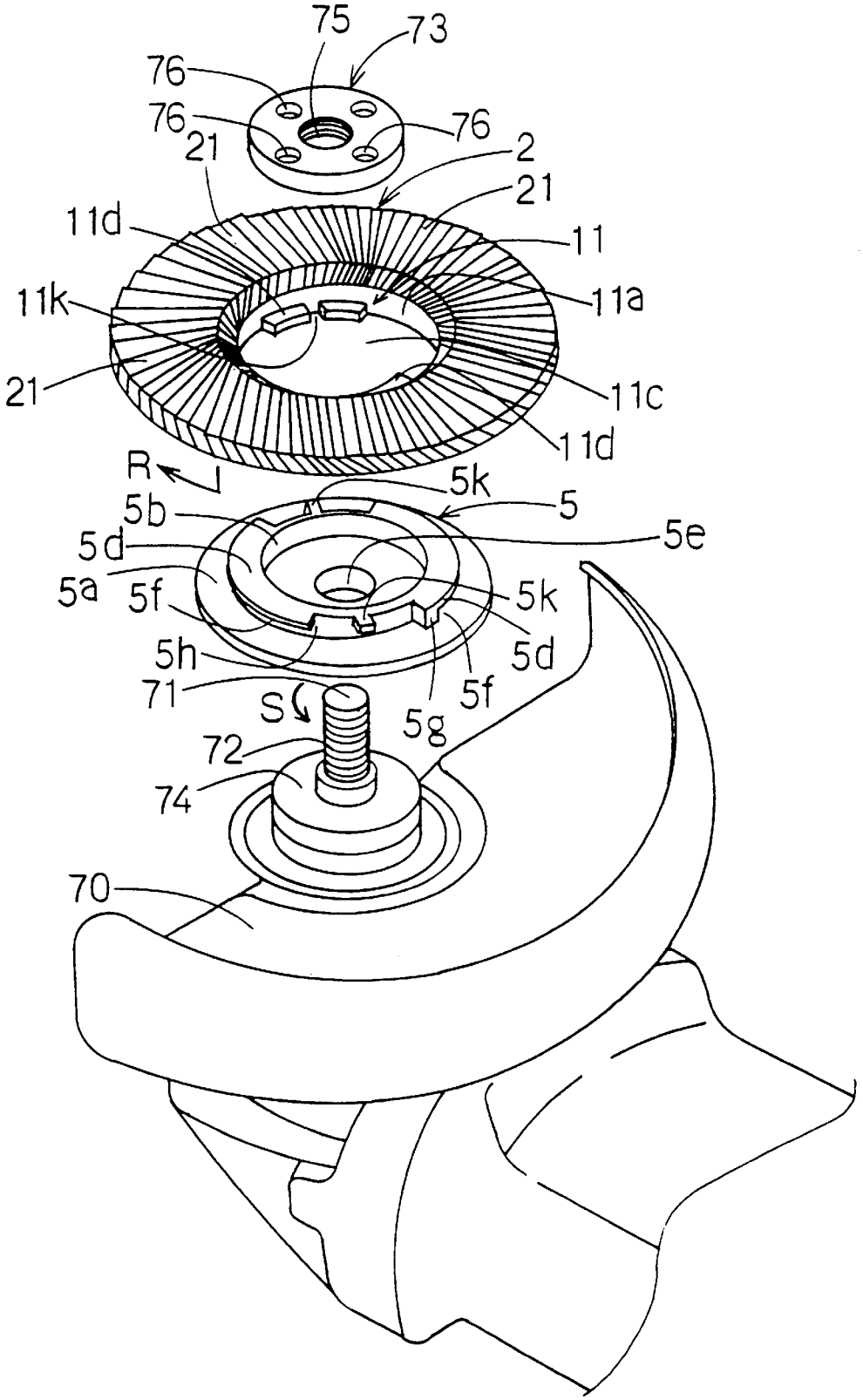
FIG. 12 is an exploded perspective view showing part of the rotating shaft of a grinder and a fifth embodiment of the rotary grinding jig in accordance with the present invention.
Figure 13:
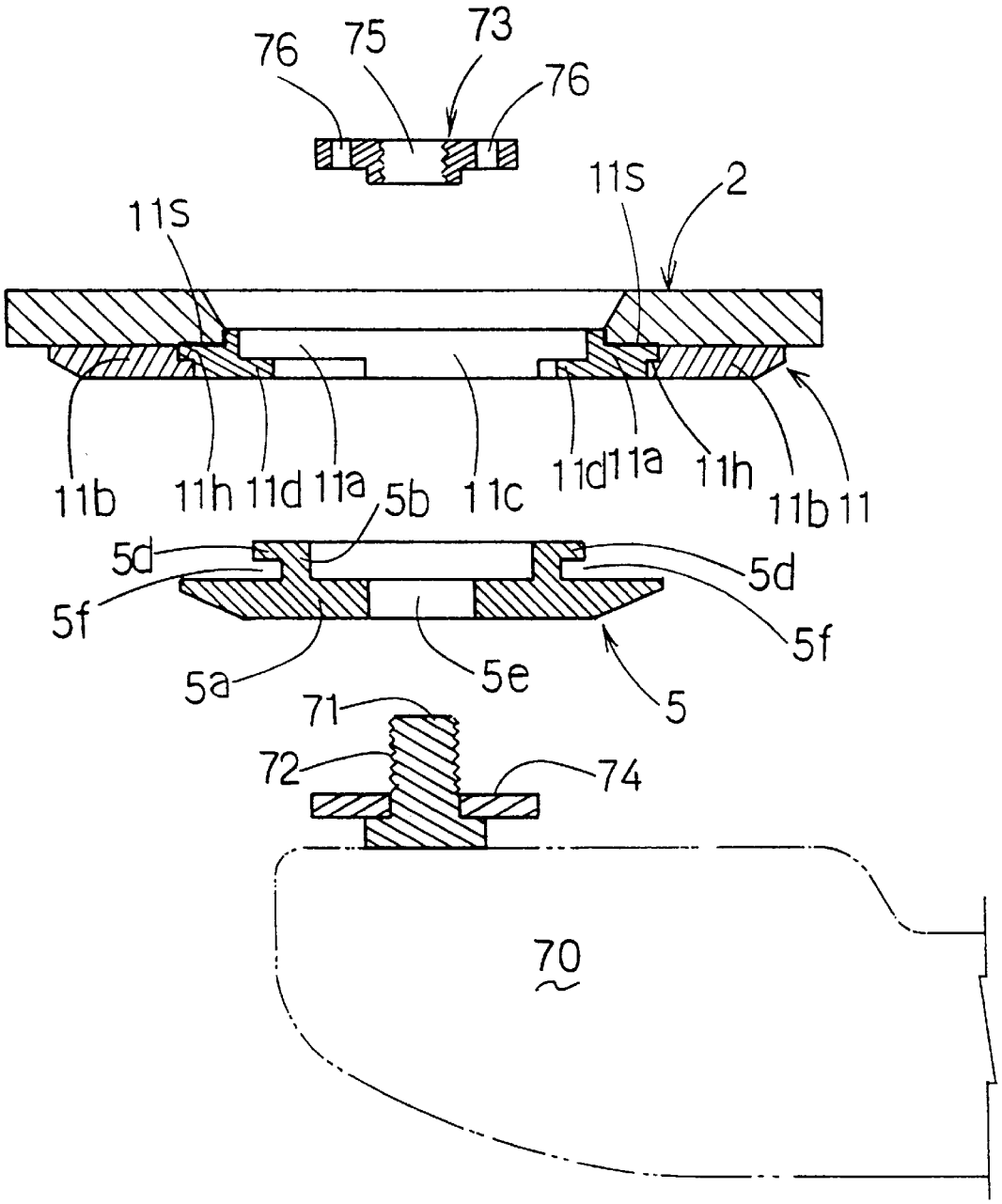
FIG. 13 is an exploded central longitudinal sectional view of the rotary grinding jig fixed to the rotating shaft of the grinder in the embodiment shown in FIG. 12.
Figure 14:
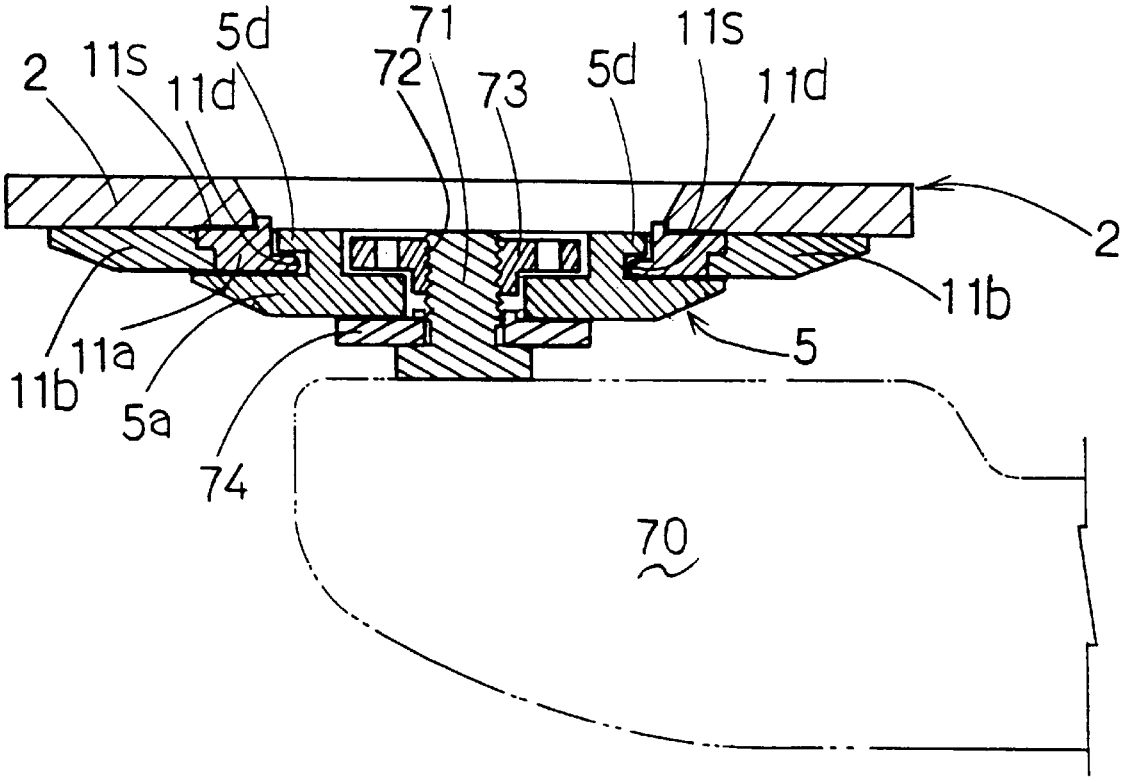
FIG. 14 is a central longitudinal sectional view of the rotary grinding jig fixed to the rotating shaft of the grinder in the embodiment shown in FIG. 12.

FIGS. 12 to 14 illustrate the rotating shaft of a grinder as a rotary drive and a fifth embodiment of the rotary grinding jig in accordance with the present invention, FIG. 12 being an exploded perspective view, FIG. 13 an exploded central longitudinal sectional view, and FIG. 14 a central longitudinal sectional view of the rotary grinding jig firmly attached to the rotating shaft of the grinder. The fifth embodiment is substantially the same as the third embodiment of the rotary grinding jig except that the retaining member is composed of two pieces.

In FIGS. 13 and 14, for easier observation sake, the thickness, a characteristic portion, of the retaining member is illustrated thicker than it actually should be, and uniform as well. The actual thickness is thinner than that illustrated, in the order of 2 to 3 mm, and is designed so as to become gradually thinner from the inside to the outside (this applies to the other figures showing the embodiments of the present invention).

This specific rotary grinding jig comprises a central member 5 to be fixed to the rotary shaft 71 of the grinder, a retaining member 11 to be removably engaged with said central member, and a grinding member 2 to be bonded to the surface of said retaining member 11. As is apparent from FIGS. 13 and 14, said retaining member 11 is composed of two pieces such as a first retaining member 11*a* positioned in the center and a second retaining member 11*b* positioned in the outside thereof. Thus, in this embodiment, the base of the rotary grinding jig is constituted by three parts, i.e. the central member 5, the first retaining member 11*a*, and the second member 11*b*; it may be compared to a three-piece article. This may apply to another other embodiments as illustrated in subsequent figures as far as FIG. 19.

The central member 5 and the retaining member 11 are made of hard synthetic resin. The grinding member 2 consists of substantially rectangular grinding sheets 21, 21 . . . such as sand paper which are slightly staggered so as to coincide in part with each other in radial arrangement. The grinding member 2 is glued by adhesive to the surface of the first retaining member 11*a* in the center of the retaining member 11 but not to the second retaining member. Incidentally, the central member 5 and the retaining member 11 may be made of metal.

In FIGS. 13 and 14, section 11*s* shown by a bold solid line designates an adhesive joint.

The foregoing configuration allows the grinding member 2 to continue grinding operation following the process that overlapped abrasive materials manifest themselves in part gradually as the grinding operation goes on. In other words, as an upper grinding sheet wears down, a lower grinding sheet appears. Any other types of grinding members are usable, but said grinding sheet such as sand paper, or an unwoven cloth incorporated with abrasive materials and having the shape of a disk and a desired thickness wherein the abrasive materials emerge from inside as said unwoven cloth wears out is particularly available.

The numeral 73 identifies a fixing screw threadly engaging onto the male threaded portion 72 of the rotating shaft 71, and 74 a packing.

The structure of the central member 5 is the same as that in the third embodiment (as shown in FIGS. 6 and 7).

The structure of the inner peripheral portion of the hollow portion 11*c* consisting of a circular through-hole in the middle of the first retaining member 11*a* of the retaining member 11 which is removably engageable with the central member 5 is also the same as that of the third embodiment.

In this connection, the fifth embodiment provides a dropout-preventive means for preventing the retaining member 11 from dropping out of the central member 5. Moreover, pin 35 may be used as a stopper member.

The procedure steps for fixing the rotary grinding jig on the rotating shaft 71 of the grinder 70 comprises engaging the central member 5 with the retaining member 11 having the grinding member 2 adhesively attached thereto, fitting the rotating shaft mounting hole 5*e* of the central member 5 onto the rotating shaft 71 with the packing 74 disposed therebetween, and then threadly engaging the fixing screw 73 onto the male threaded portion 72 of the rotating shaft 71 for further tight fitting by a tool.

Alternatively, after only the central member 5 has been mounted on the rotating shaft 71 with the packing 74 interposed between them into tight fitting by the fixing screw 73, the retaining member 11 may be mounted on the central member 5 in accordance with said procedure steps.

It is essential that the maximum outer diameter of the fixing screw 73 be smaller than the minimum inner diameter of the retaining member 11. This permits removal of the retaining member 11 from the central member 5 with the central member 5 remaining firmly fitted on the rotating shaft of the rotary drive of a grinder.

Both the first and second retaining members 11*a* , 11*b* of the retaining member 11 are not fixed by only connected with each other by joining the outer periphery of one of the members to the inner periphery of the other one through steps 11*h* provided on the respective peripheries (see FIGS. 13 and 14). However there is no risk of the second retaining member 11*b* positioned in the outside from coming off because it is held with the grinding member 2 and the central member 5, while positioned between the latter, as described afterward.

In the grinding operation using this rotary grinding jig, if the grinding member 2 wears out and its outer periphery gets substantially equal to the outer diameter of the second retaining member 11*b* of the retaining member 11, such a resulted outer periphery is no longer useful for further grinding.

In the present invention, this is indeed the time when the second retaining member 11*b* in the outside of the retaining member 11 may be removed.

If the retaining member 11 provided on the grinding member is turned in the direction of arrow S as shown in FIG. 12 to remove it from the central member 5, then the second retaining member 11*b* is ready to be simply removed from the first retaining member 11*a*, and if need be, the grinding operation can be resumed by mounting a retaining member formed with the first retaining member 11*a* only on the central member 5.

This is because the grinding member 2 is still capable of continuing the grinding operation without the second retaining member 11*b* mounted on the rear side of the periphery of the grinding member 2 until the attribution of the grinding member 2 develops close to the outer periphery of the first retaining member 11*a*. This matter will be discussed in detail later.

IF the grinding member 2 finally becomes unusable, it is not necessary to loosen the fixing screw 73 to remove the central member 5. The worn grinding member 2 and the first retaining member 11*a* only are turned in the direction opposite to the direction of rotative engagement R so as to bring the notches 11*k* of the first retaining member 11*a* and the locking projections 5*k* of the central member 5 into positional agreement with each other. Then, the first retaining member 11*a* may be simply removed from the central member 5 and discarded accordingly.

Thus, once the central member 5 has been mounted on the rotating shaft 71, exchange for another retaining member 11 provided with a new grinding member 2 can be simply performed without the necessity of removing the fixing screw and conducting any fixing operation.

The second retaining member 11*b* in the outside of the retaining member 11 can also be used again and again just like the central member 5.

The process for fixing the rotary grinding jig on the rotating shaft 71 of the grinder 70 maybe made in the following manner. To begin with, the central member 5 is mounted on the rotating shaft 71 with the packing 74 interposed between them, threadly engaging the fixing screw 73 on the rotating shaft 71 by hand, tightening the fixing screw 73 by turning it by means of a toll until the central member 5 can be fully secured to the rotating shaft 71. Thereafter, the retaining member 11 is mounted on the central member 5 following said procedure, and then, the rotary grinding jig in accordance with the present invention has been mounted and fixed to the rotating shaft 71 of the grinder 70 (FIG. 14).

Alternatively, the central member 5 and the retaining member 11 are combined with each other in advance, and then, this rotary grinding jig can be fixed to the rotating shaft 71 of the grinder 70 using the fixing screw 73.

Figure 15:
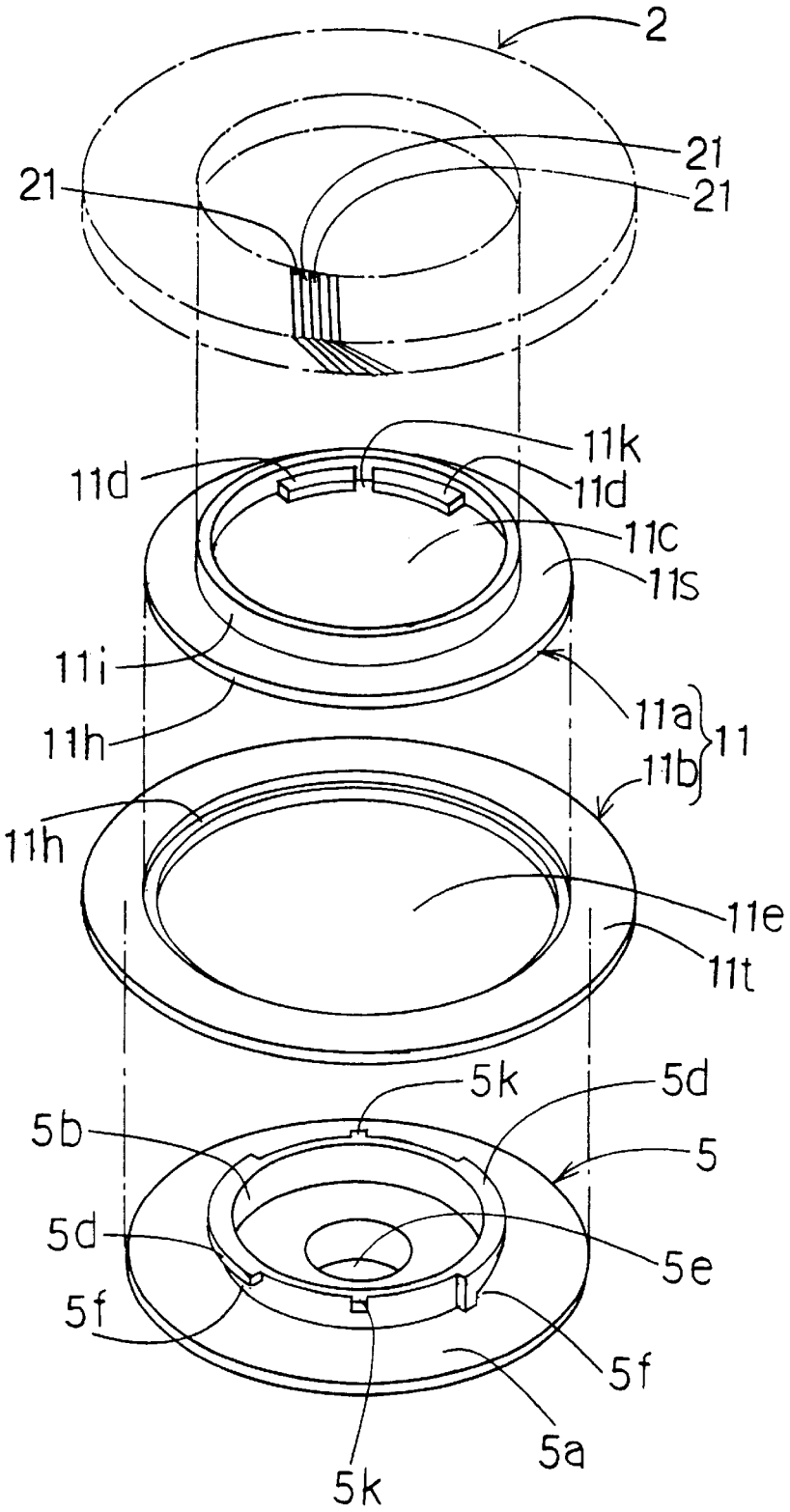
FIG. 15 is a perspective view explanatory of the disassembly of all the components of the rotary grinding jig as shown in FIGS. 12 to 14.

FIG. 15 is a perspective view explanatory of the disassembly of all the components of the rotary grinding jig as shown by FIGS. 12 to 14.

The grinding member 2 is composed of a plurality of grinding sheets 21. Each of the grinding sheets 21 is a small piece having substantially a rectangular or trapezoidal shape. The grinding sheet so called here includes cloth coated with abrasive powders as well as paper, such as sand paper, coated with abrasive powders.

The respective grinding sheets 21 are arranged on top of one another with the adjacent grinding sheets 21 leaning against each other, i.e. inclining relative to the surface of the retaining member 11 so as to be glued by adhesive to the first retaining member 11*a* of the retaining member 11. In addition to the sand paper, whetstones, unwoven cloths, rubbers, diamonds, etc., can be used as the grinding member.

The retaining member 11 comprises the first retaining member 11*a* in the central side thereof and the second retaining member 11*b* positioned in the outside thereof, the outer periphery of the former being joined to the inner periphery of the latter. The joint or combination between both members only takes the form of an engagement so that they are removable from each other.

As above-mentioned, the first retaining member 11*a* has a circular hollow portion 11*c* formed in the middle thereof and including a cylindrical portion 11*i* extending in the surface side (the upper side in the drawing) and two ridges 11*d* serving as a rotative engagement portion formed on its inner periphery and having a length substantially equal to a quarter of its circumferential length. A notch 11*k* is formed substantially in the middle of each of the ridges 11*d*. The number of ridges 11*d* and notch 11*k* as indicated was simply given by way of example, so it is properly changeable.

the second retaining member 11*b* positioned in the outside of the retaining member 11 consists of a ring-shaped disk having in the middle thereof a through-hole 11*e* which may receive said first retaining member 11*a*.

When the first and second retaining members 11*a*, 11*b* are combined with each other into a retaining member 11, the surface 11*s* of the first retaining member 11*a* and the surface 11*t* of the second retaining member 11*b* are positioned flush with each other so as to support the grinding member 2 from behind.

There is provided a step portion 11*h* running all through the inner periphery of the through-hole 11*e* of the second retaining member 11*b*, and another step portion 11*h* which is adaptable to said step portion 11*h* is also provided on the outer peripheral edge of the first retaining member 11*a*.

The above-described configuration permits the central member 5 to removably engage with said retaining member 11 at all times with the central member 5 and the rotating shaft of the rotary drive in fixed relationship. If the grinding member 2 has worn out to the second retaining member 11*b*, the retaining member 11 is removed from the central member 5, followed by further removal of the second retaining member 11*b* of the retaining member 11, thereby enabling continuation of another grinding operation.

Thereafter, if the grinding member 2, wears further to the first retaining member 11*a* this grinding member 2 and the first retaining member 11*a* are thrown away so as to be exchanged for new ones.

Figure 16:
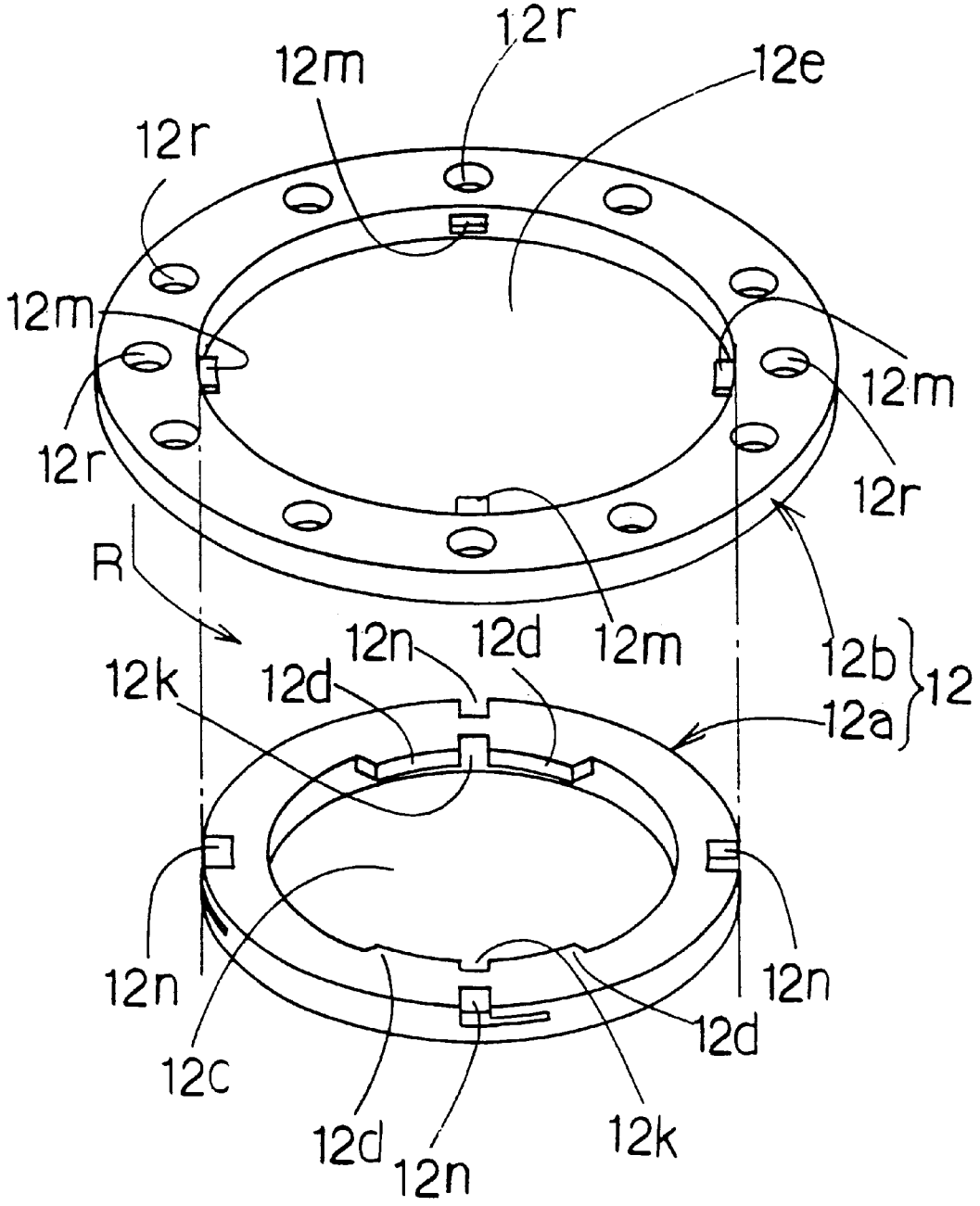
FIG. 16, showing another embodiment of a retaining member in accordance with the present invention, is a perspective view explanatory of first and second retaining members separated from each other, as viewed from the rear side.
Figure 17:
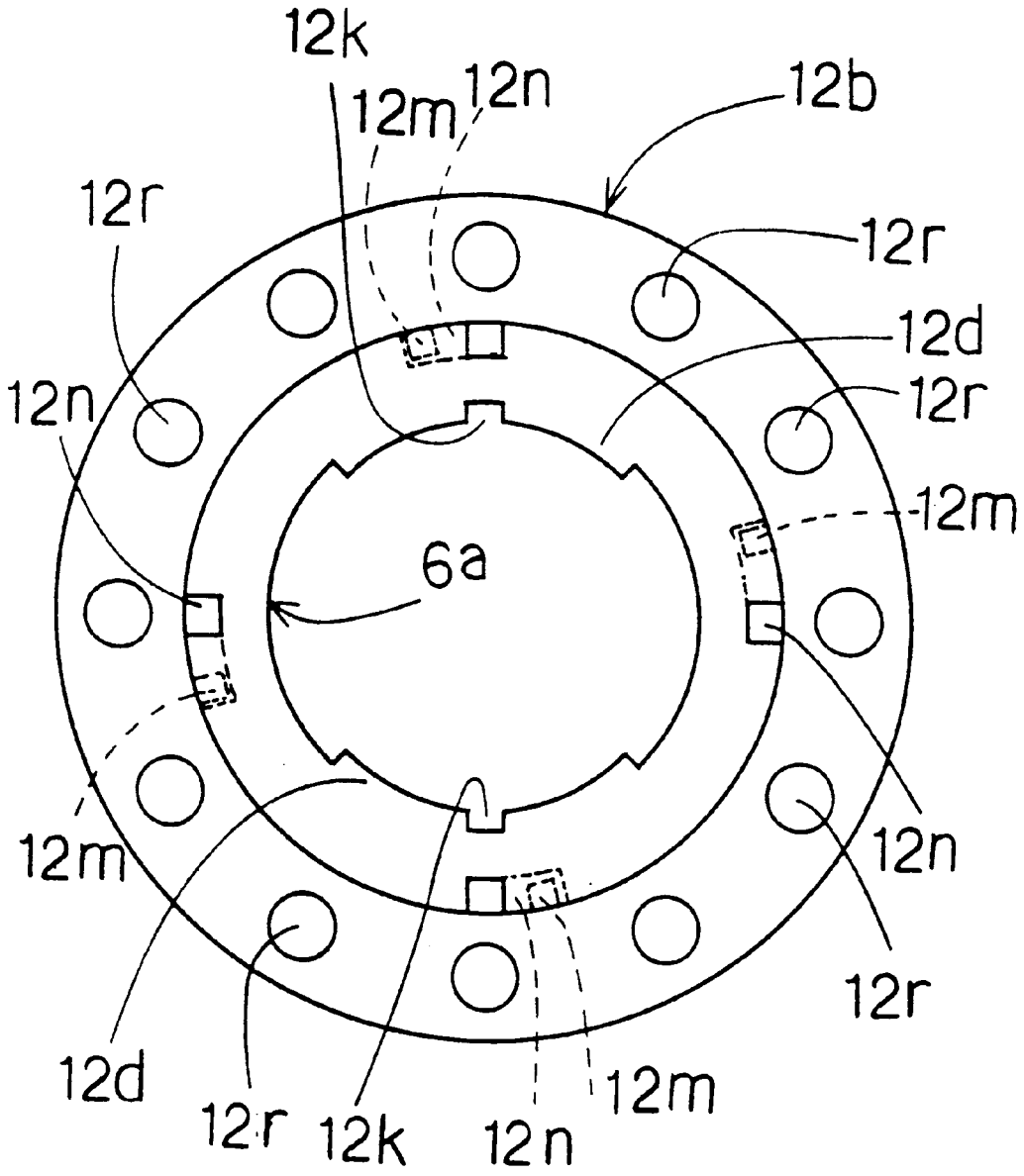
FIG. 17 is a rear elevation of the retaining member with both members combined with each other.

FIGS. 16 and 17 illustrate another embodiment of the retaining member in accordance with the present invention, FIG. 16 being a perspective view showing from behind the disassembly of the first retaining member and the second retaining member, and FIG. 17 a rear elevation showing the assembly of both members. In these drawings, the ones illustrated in FIGS. 12 to 15 are shown inside out. The grinding member is shown positioned in the underside, accordingly.

A retaining member 12 as illustrated in said drawings is different from that of the embodiment as shown in FIG. 15 only in the engagement portion for the first and second retaining members 12*a*, 12*b* except for the other structures.

The first retaining member 12*a* has ridges 12*d* formed on the inner peripheral edge of the hollow portion 12*c* for engaging with the central member, and the ridges 12*d* includes notches 12*k* in the middle thereof respectively.

There are provided grooves 12*n* as a receiver cut in and spaced on the outer peripheral edge of the first retaining member 12*a*. The grooves 12*n* each extend further peripherally of the first retaining member 12*a*, so that they look like the letter L viewed from the side.

The second retaining member 12*b* consists of a ring-shaped disk having a through-hole 12*e* in the center thereof, its outer diameter being slightly smaller than that of the grinding member 2, and the through-hole 12*e* having ridges 12*m* as an engagement portion spaced in four sections of the inner periphery thereof.

These ridges 12*m* are adapted to be engaged in the grooves 12*n* as provided on the outer peripheral edge of the first retaining member 12*a*. Both the ridge 12*m* and groove 12*n* function as engagement means.

In FIG. 16, the second retaining member 12*b* is moved downwards as to bring the ridges 12*m* provided on the inner periphery of the through-hole 12*e* and the openings of the grooves 12*n* cut in the outer peripheral edge of the first retaining member 12*a* into positional coincidence with each other to force the second retaining member 12*b* into the outside of the first retaining member 12*a*. Then, by turning the second retaining member 12*b* in the direction of arrow R, the ridges 12*m* and the grooves 12*n* can be combined with each other.

Contrary to the described structure in the ridges 12*m* and the groves 12*n*, the ridges 12*m* may be provided on the outer peripheral edge of the first retaining member 12*a* and the grooves 12*n* may be provided on the inner peripheral edge of the second retaining member 12*b*.

the retaining member 12 into which the first and second retaining members 12*a*, 12*b* has been mutually combined with each other is in a position to be engaged with the central member 5. Since the central member 5 has been made slightly larger than the first retaining member 12*a* in outer diameter, there is no fear of the second retaining member 12*b* dropping out of the first retaining member 12*a*.

In this embodiment, however, as there is no separation of the second retaining member 12*b* from the first retaining member 12*a* by any chance on the ground that the first and second retaining members 12*a*, 12*b* stand in the engaged association with each other by the aid of ridges 12*m* and the grooves 12*n*. Namely as due to the engagement between the ridges and the grooves, there is no chance whatsoever of the second retaining member 12*b* leaving the first retaining member 12*a* under the influence of a force running from the surface side in which the retaining member is positioned to the rear side. Although the second retaining member 12*b* is exposed to attack of said force, there is not need of the second retaining member 12*b* being backed up, and so, the outer diameter of the central member 5 can be made smaller than that of the first retaining member 12*a*. This means that the second retaining member 12*b* may not be held by the grinding member 2 and the central member 5 in a position between the two members.

The grinding member glued to the first retaining member 12*a* is not shown in FIGS. 16 and 17.

With this embodiment, a plurality of circular holes 12*r* are arranged in line. These holes 12*r* are intended for clamping the first retaining member 12*b* against the first retaining member 12*a* when in the mounting operation for the members and radiating heat while the rotary grinding jig is at work as well. This radiation of heat is very effective. Heat produced in the grinding member during the grinding operation can be discharged through said holes, which, thus, can achieve the air cooling function thereby avoiding any scorching of the grinding member and workpieces to be ground.

This specific hole may also be used in all the other embodiments as disclosed here.

This effect of heat dissipation is also attributed to the generation of air flows between the outer peripheries of the grinding sheets because in this embodiment, the grinding member is composed of a plurality of grinding sheets and these grinding sheets are only adhesively attached to the first retaining member 12*a* positioned in the center.

In this embodiment, the number of the ridges 12*m* and the grooves 12*n* may be adequately changed as needed.

The second retaining member 12*b* positioned in the outside can be dismounted from the first retaining member 12*a* even if the first retaining member 12*a* is kept in contact with the central member 5.

Furthermore, the grooves having the shape of a letter L viewed from the side and extending in the peripheral direction may be formed so as to further extend in a reverse direction at the corner of the grooves 12*n*.

Figure 18:
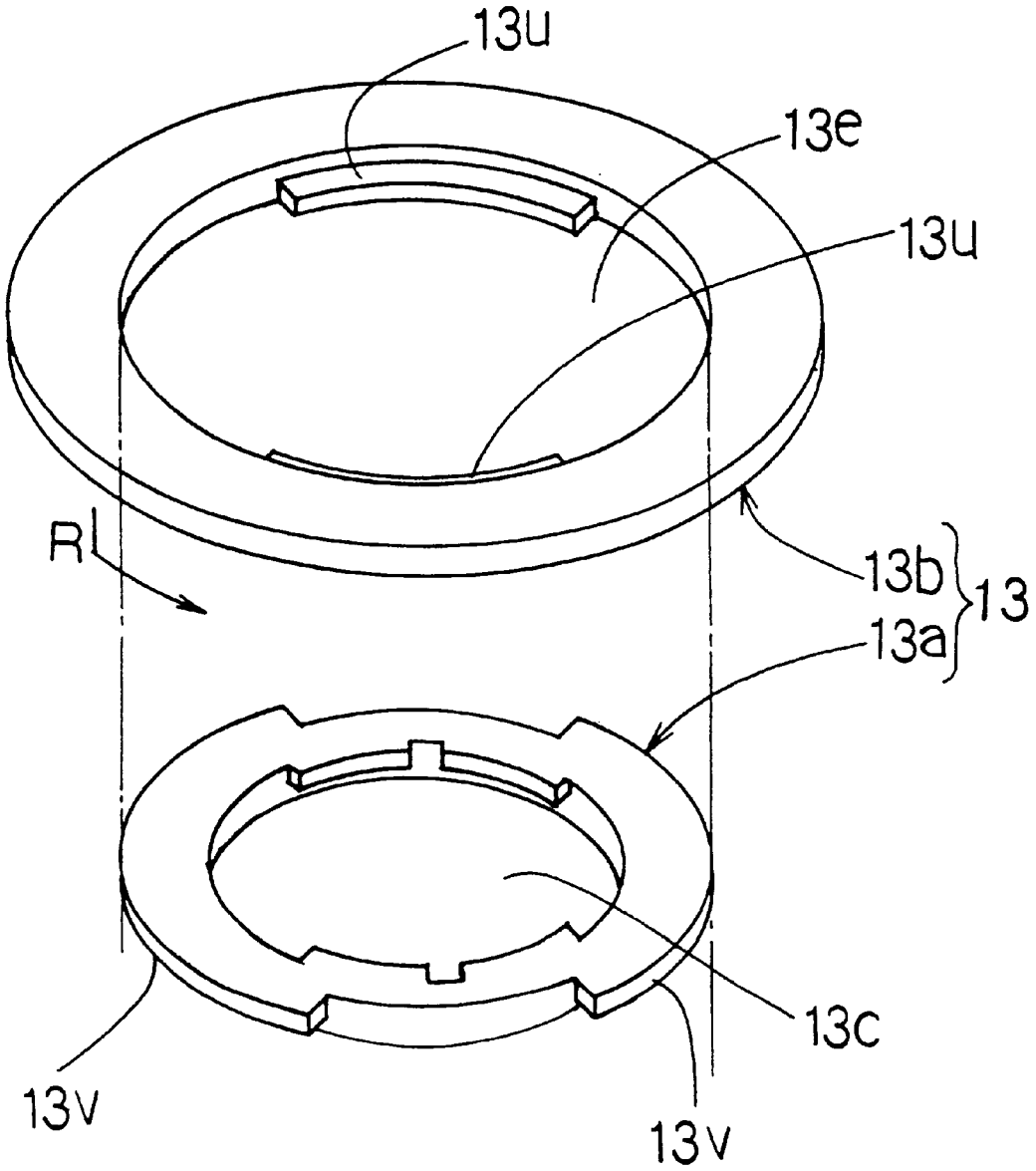
FIG. 18, showing a further embodiment of the retaining member in accordance with the present invention, is a perspective view explanatory of the first and second retaining members separated from each other, as viewed from the rear side.

FIG. 18 illustrates another embodiment of the retaining member in accordance with the present invention with a perspective view of the disassembly of the first retaining member and the second retaining member viewed from the side. This drawing does not show the grinding member adhesively attached to a first retaining member 13*a* either, but the grinding member is actually designed to be joined to the lower side of the first retaining member 13*a*.

The structure of the hollow portion 13*c* of the first retaining member 13*a* is the same as that of the embodiment as shown in FIG. 16. Therefore, no explanation will be made.

The first retaining member 13*a* includes two extensions 13*v* each having a length compared to substantially a quarter of the circumference thereof and formed in two positions symmetrically about a point. A second retaining member 13*b* is adapted to engage at its ridges 13*u* (engaging position) with the undersides of these extensions 13*v* (engaged position). More than two extension 13*v* may be used as needed.

The ridges 13*u* and the undersides of the extensions provide an engagement means.

On the other hand, the second retaining member 13*b* consists of a ring-like disk, having ridges 13*u* each having a length compared to substantially a quarter of the circumference thereof and formed symmetrically on the surface side of the inner periphery of a central through-hole 13*e* in two points. More than two ridges 13*u* may also be used as needed.

Engagement of the ridges 13*u* with the underside of the extensions 13*v* (engaged position) may be achieved by fitting the second retaining member 13*b* into the first retaining member 13*a* from the rear side and turning the former in the direction of arrow R.

A design may be provided such that the ridge 13*u* can be abutted by one end against a terminal portion provided on a proper position of the underside of the extension 13*v* into engagement with the latter. If the terminal portion is provided on the intermediate site of each extension 13*v*, the engagement operation will be completed by the ridge 13*u* which has abutted against the terminal portion, and the ridge 13*u* will abut against another terminal portion even when it turns in an opposite direction in which disengagement takes place. Thus, said terminal portion may provide a dropout-preventive means.

In order to establish more assured engagement between the ridges 13*u* and the extensions 6*v*, one or more projections are provided on the upper face of the ridge 13*u* and one or more depressions are provided on the lower face of the extension 6*v* in such a manner that both the ridge and extension may be engaged with each other. There may be used an arrangement to the contrary; the projection may be defined on the lower face of the extension 6*v* and the depression on the upper face of the ridge 6*u*. Naturally, this specific arrangement of these projection and depression may be applied to the engagement means in the other embodiments.

This embodiment can also be practices by the central member 5 whose outer diameter is smaller than the maximum outer diameter of the first retaining member 13*a* as in the embodiment shown by FIG. 16. This is because it is not necessary for the second retaining member 13*b* to be supported by the grinding member and central member in a position between them. It is natural, however, that the outer diameter of the central member may be larger than the maximum diameter of the first retaining member 13*l* in a manner such that the central member can back up the second retaining member 13*b* from behind.

If the outer diameter of the central member 5 is made smaller than the maximum diameter of the first retaining member 13*a* and also smaller then a the inner diameter of the second retaining member 6*b*, the second retaining member 13*b* can be separated from the first retaining member 13*a* with the first retaining member 13*a* and the central member 5 kept in engagement relationship, thus resulting in easier removal of the second retaining member 13*b* when the grinding member if worn out.

Figure 19:
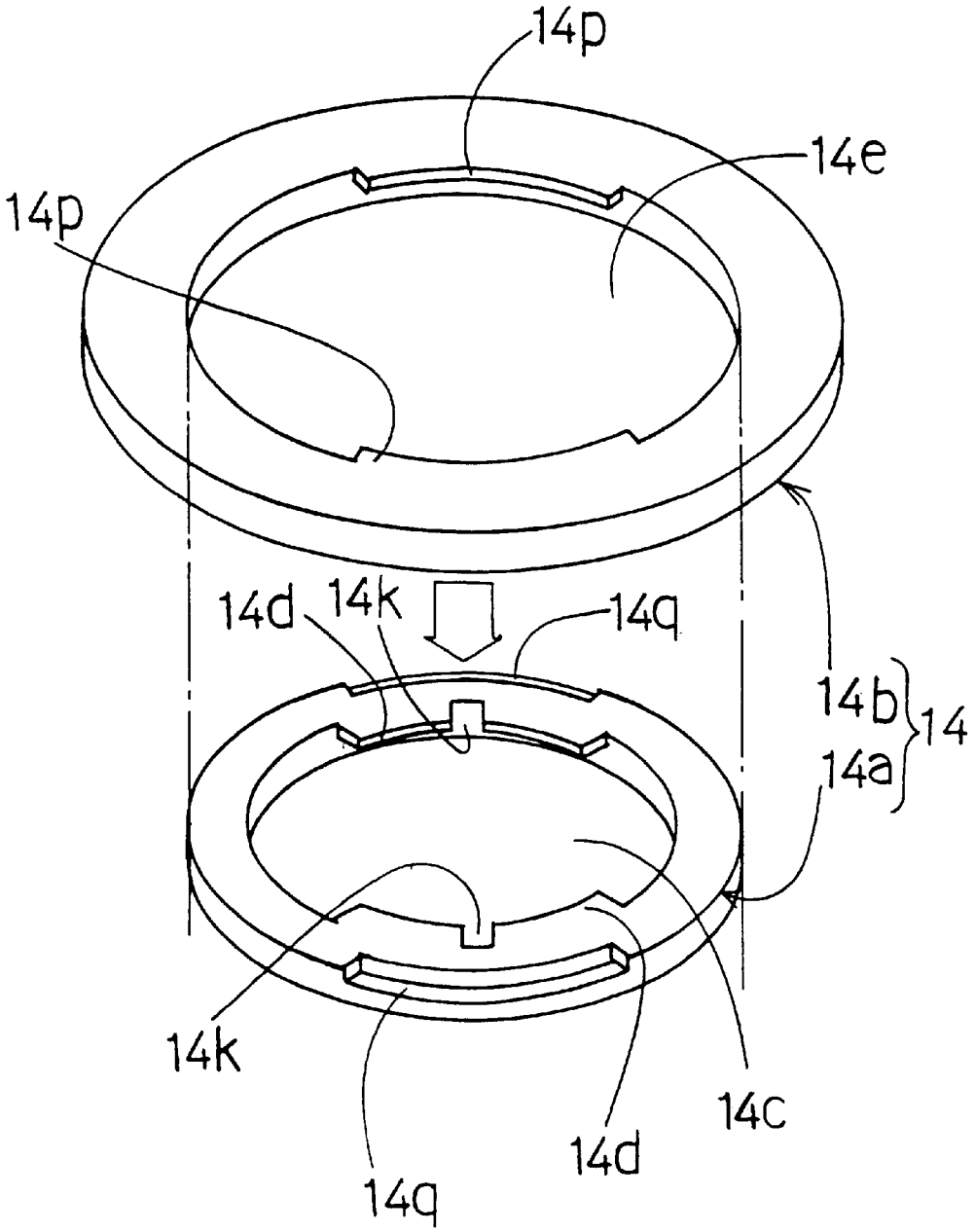
FIG. 19, showing another embodiment of the retaining member in accordance with the present invention, is a perspective view explanatory of the first and second retaining members separated from each other, as viewed from the rear side.

FIG. 19 illustrates another embodiment of the retaining member in accordance with the present invention with a perspective view of the disassembly of the first and second retaining members viewed from the side.

The grinding member adhesively attached to a first retaining member 14*a* is not shown in this drawing either. This grinding member is adapted to be joined to the underside of the first retaining member 14*a*.

The structure of the inner periphery of the hollow portion 14*c* of the first retaining member 14*l* is the same as that of said previous embodiment.

On the outer periphery, depressions 14*q* are formed in two symmetrical positions. Ridges 14*p* defined on the inner periphery of through-hole 14*e* of a second retaining member 14*b* may be appropriately received by said depressions 14*q*.

As in the previous embodiment, the second retaining member 14*b* consists of ring-like disk having the through-hole 14*e* formed in the middle thereof. The ridges 14*p* are disposed on the rear side of the inner periphery of the through-hole 14*e* in two symmetrical positions so that the ridges 14*p* may be fitted in the depressions 14*q* defined on the outer periphery of said first retaining member 14*a* respectively.

There may also be available an arrangement to the contrary; the ridges 14*p* are provided on the first retaining member 14*a* and the depressions 14*q* on the second retaining member 14*b*.

Engagement of the first retaining member 14*a* and the second retaining member 14*b* can be achieved by bringing the depressions 14*q* of the first retaining member 14*a* and the ridges 14*p* of the second retaining member 14*b* into positional agreement with each other and allowing the second retaining member 14*b* to come from the rear side of the first retaining member 14*1* to the outside of the first retaining member 14*a* so as to place the second retaining member 14*b* on the first retaining member 14*a* for engagement purposes. And then, although not specified in the drawing, the central member having an outer diameter larger than the inner diameter of the second retaining member 14*b* is engaged by its rear side (from above in the drawing) with the second retaining member 14*b* to ensure that the second retaining member 14*b* will be secured to the first retaining member 14*a*.

When the grinding member mounted on the grinder wears out during the grinding operation to such a degree that its outer periphery had reduced almost equal to the outer diameter of the second retaining member 14*b*, the retaining member 14 is removed from the central member 5, then the second retaining member 14*b* in the outside is removed from the retaining member 14, then the first retaining member 14*a* formed integral with the worn-out grinding member is mounted on the central member 5 again for further grinding operation. The subsequent grinding operation can last until the attrition of the grinding member develops close to the outer periphery of the first retaining member 14*a*.

The structure of engagement in this embodiment is excellent in that as the engagement of the first and second retaining members 14*a*, 14*b* of the retaining member 14 is based on the engagement of the depressions 14*q* and the ridges 14*p*, both members can be fully prevented from turning relative to each other when the grinding operation is in action or has come to a stop.

Figure 20:
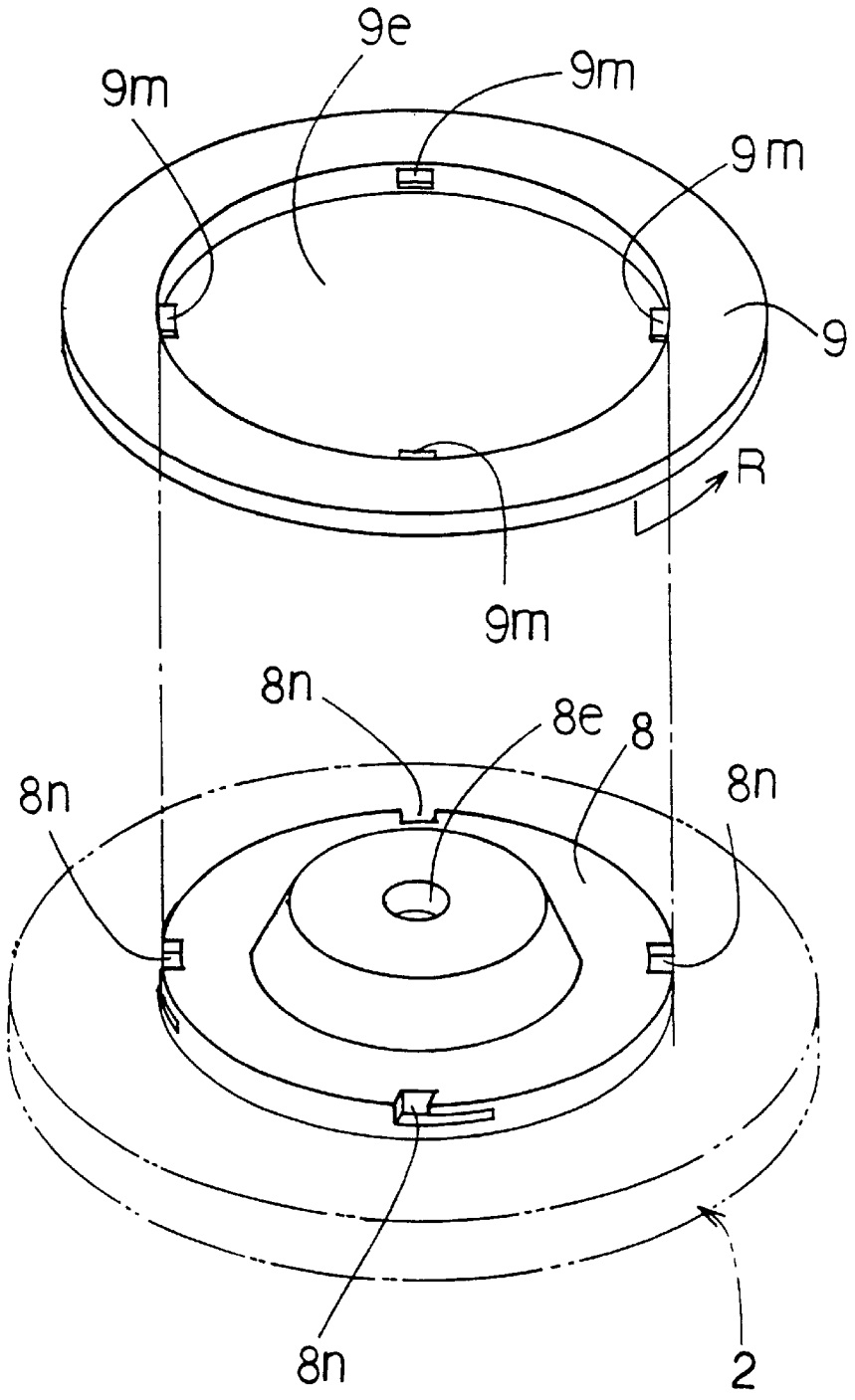
FIG. 20, showing another embodiment of the rotary grinding jig in accordance with the present invention, is a perspective view explanatory of the components separated from each other, as viewed from the rear side.

FIG. 20 illustrates a further embodiment of the rotary grinding jig in accordance with the present invention with a perspective view of separated components of said jig observed from the side.

In this embodiment, unlike in the aforementioned embodiments, the base of the rotary grinding jig is not of a three-piece type but a two-piece one. In this drawing, the grinding member is designed to be adhesively joined to the base of the underside, too.

The base substantially in the shape of a disk consists of two components such as a central portion 8 and an outer peripheral portion 9 positioned on the outside of said central member. The central member 8 has a rotating shaft mounted hole 8*e* formed in the center thereof to fixedly receive the rotating shaft of a grinder, and four grooves 8*n* as an engaged portion spaced on the outer peripheral edge.

More specifically, each of the grooves 8*n* is formed substantially in the shape of a letter L such that it extends from the rear side down to a point at the surface side where it further spreads in a peripheral edge.

The outer peripheral portion 9 positioned on the peripheral side of the base is a ring-like disk type, having four projections 9*m* serving as an engaging portion formed on the inner periphery thereof.

The outer peripheral portion 9 and the central portion 8 may be combined with each other by engaging these projections 9*m* with the grooves 8*n* formed on the outer peripheral edge of the central portion 8.

More specifically, the projections 9*m* of the outer peripheral portion 9 and the openings of the grooves 8*n* in the central portion 8 are brought into positional agreement with each other, and then, the central through-hole 9*e* of the outer peripheral portion 9 is allowed to come from the rear side of the central portion 8 to the outer peripheral face of the central portion 8 for coincidence purpose until the outer peripheral portion 9 is fitted into the central portion 8, and if the outer peripheral portion 9 is turned in the direction of arrow R, both portions may be joined with each other.

By the aid of the engagement through this engagement means, the outer peripheral portion 9 can cope with a force travelling in an axial direction of the rotating shaft, i.e., from the surface side (grinding member 2's side) to the rear side.

Of course, the grinding member 2 is only joined by adhesive to the surface side of the central portion 8 but not to the surface of the outer peripheral portion 9. Therefore, the outer peripheral portion 9 can be removed from the central portion 8.

The grinding member 2 may be of any type as in said embodiments.

In this invention, therefore, the base compound of two members can be available for practice as a two-piece type as in this embodiment.

In this embodiment, the bases of various kinds can be employed as engagement means like the one of a three-piece type as mentioned above. So, the engagement means as shown in FIG. 18 is also applicable. This particular engagement means may be of any structural type as long as it permits the peripheral portion 9 combined with the central portion 8 to match for a force running from the surface side to the rear side.

The peripheral length of the projection 9*m* and the number of same may be properly set as needed.

FIG. 21 is a sectional view explanatory of the state in which the rotary grinding jig of the fifth embodiment as shown in FIGS. 12 to 14 has worn down, (A) showing the wearing limit of said jig with the second retaining member attached thereto, and (B) the wearing limit of same with no second retaining member.

Figure 21A:
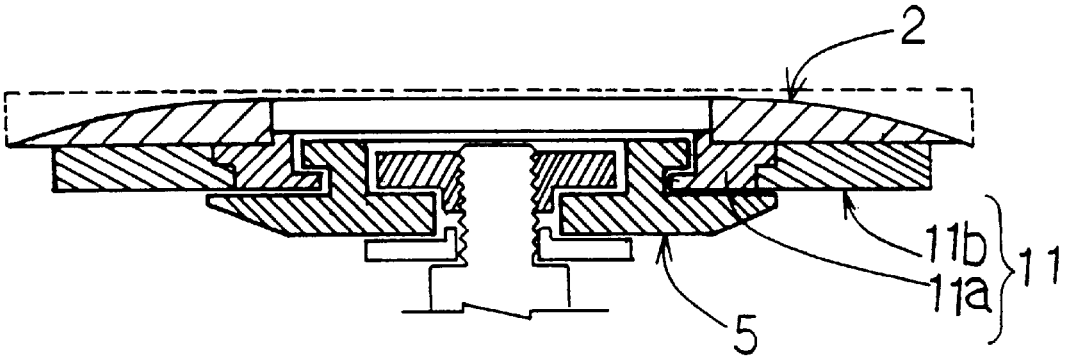
FIG. 21 is a sectional view explanatory of worn-out rotary grinding jigs in accordance with the fifth embodiment of the present invention as shown in FIGS. 12 through 14, (A) showing the limit of attrition of a rotary grinding jig with the second retaining member, and (B) showing the limit of attrition of a rotary grinding jig without the second retaining member.

Referring to FIG. 21(A), the retaining member 11 is a combination of a first retaining member 11*a* in the center and a second retaining member 11*b* on the outside thereof. In operation, the grinding member 2 gradually wears thinner in the central portion and its outer peripheral edge portion also gets extinct from the frontal part. When the diameter of the peripheral edge portion approaches the outer peripheral edge portion of the second retaining portion 11*b* on the outside of the retaining member 11, the grinding operation may become difficult to perform. This is because the peripheral edge portion of the second retaining member 11*b* is an obstacle to grinding.

In this state, since the first and second retaining members 11*a*, 11*b* are kept in contact with each other, grinding can be carried out with the grinding member 2 being strongly pressed on a workpiece to be ground.

Figure 21B:
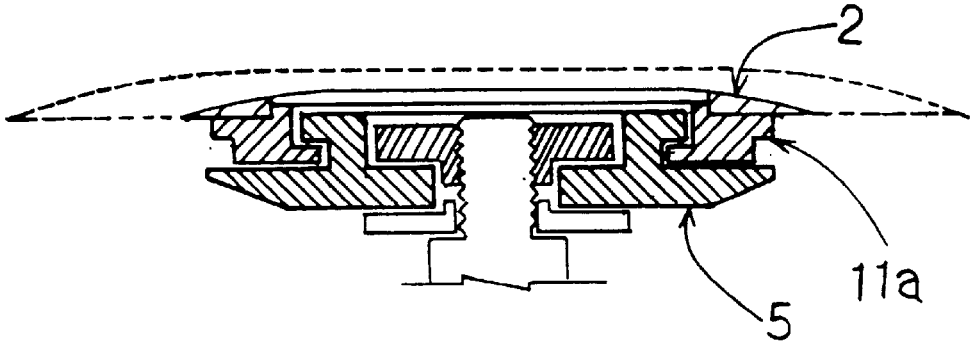
Figure 22:
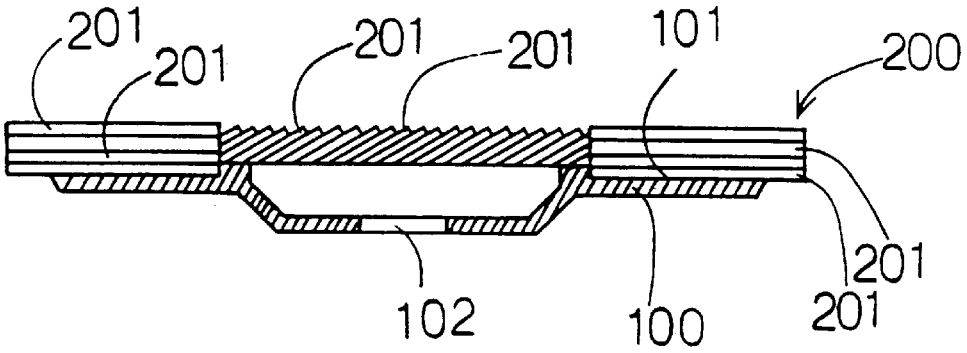
FIG.22 PRIOR ART
FIG. 22 shows a central longitudinal sectional view of rotary grinding jigs of a conventional type, (A) showing the one before use, and (B) showing the other one with a worn-out grinding member after use.
Figure 22:
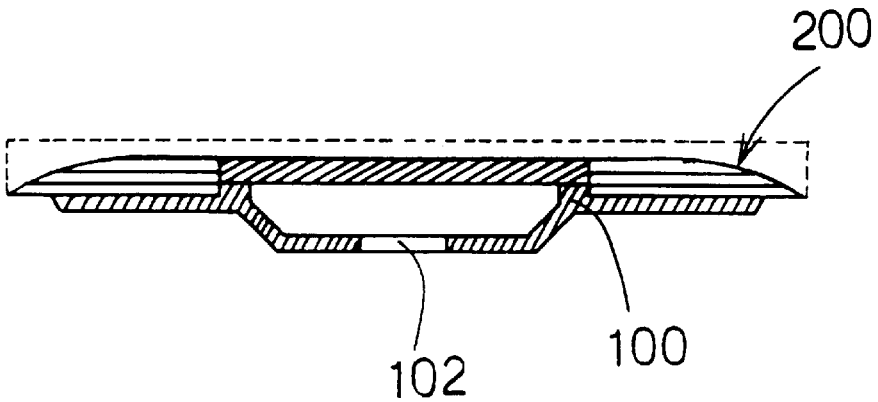
FIG.22 PRIOR ART

At the time when the grinding member 2 is worn away by friction, the retaining member 11 is removed from the central member 5, the second retaining member 11*b* on the outside is withdrawn, and the first retaining member 11*a* on which the worn-out grinding member 2 rests is engaged with the central member 5 again (FIG. 21(B)) for further continuation of the grinding operation.

As this operation goes on, the attrition of the grinding member 2 increases so as to render the central portion thinner, and then, the outer peripheral edge portion reduces in size nearly to the outer diameter of the outer peripheral edge portion of the first retaining member 11*a*, when the grinding operation can no longer continue. The grinding member 2 has become unusable by now, and is thrown away.

After the second retaining member 11*b* has been discarded, there exists no retaining member 11 on the outside, so the grinding member 2 can be brought into a soft touch with a workpiece to the ground, whereby the optimum grinding intended for curved area on workpieces being ground can be put into practice.

As observable from FIGS. 21(A) and (B) (the section of the grinding member 2 as indicated with a dotted line in FIG. 21(B) identifies the grinding member 2 as shown by FIG. 21(A)), if a retaining member used is not of a two-piece type, the grinding member as shown in FIG. 21(A) has clearly done its term of service, but the structure of the retaining member of a two-piece types makes it possible to use the grinding member 2 until it wears out to a degree as shown in FIG. 21(B), so this can greatly decrease disposal of grinding members.

As described above, in said embodiments in accordance with the present invention, the rotary grinding jig comprising a central member 5, a retaining member 11, and a grinding member 2, the central member 5 and the retaining member 11 being removably joined to each other, is characterized in that the retaining member 11 is composed of two members such as a first retaining member 11*a* positioned in the center and a second retaining member 11*b* on the outside thereof (namely, the base is of a three-piece type, comprising central member 5, first retaining member 11*a* and second retaining member 11*b*), and that the second retaining member 11*b* on the outside can be removed dependent on the degree of attrition of the grinding member 2.

Alternatively, the base is characterized in that it is made up of two components (i.e. of a two-piece type) such as a central member 8 and an outer peripheral portion 9 so that the outer peripheral portion 9 and central member 8 can be removably joined to each other, and that the outer peripheral portion 9 can be removed dependent on the degree of attrition of the grinding member 7.

The structure of engagement means for the first and second retaining members 11*a*, 11*b* of the retaining member 11 may be completely designed.

The outer peripheral face of the first retaining member 11*a* is simply constituted by a true vertical plane, and the inner peripheral face of the through-hole 11*e* of the second retaining member 11*b* is also constituted by a vertical plane without providing any engagement means in such a manner that both members can be fitted with each other. In the alternative, it is natural that such a joining area may provide an inclined plane. In this case, the maintenance of engagement and fixing of both members can be made possible by pressing the disk body 5*a* of the central member 5 from the surface side. That is, the second retaining member 11*b* may be maintained by the central member 5 on the rear side thereof and cope with a force running from the surface side to the rear side.

Various types of mechanical engagement means such as the engagement of projections and depressions, the engagement of corresponding step portions, the rotative engagement of projections and grooves, etc., can be employed as engagement means for the first and second retaining members 11*a*, 11*b* of the retaining member 11. One of these engagement means may be provided in either of the first and second retaining members 11*a*, 11*b*, and the other one in the other retaining member.

The design for material, shape, thickness, size, etc., of each of the components may be freely changed.

For the grinding member, sheet-like products of different kinds of materials such as paper, cloth, or unwoven cloth with various sorts of abrasive particles covering the length and breadth thereof, or with abrasive particles incorporated in the surface and inside thereof, or a disk-like product having abrasive particles combined thereinto and a predetermined thickness, and product of a type in which abrasive particles will emerge therefrom sequentially as a wearing away by friction advances is particularly preferable.

With the base composed of two-pieces the central member an the outer peripheral portion, both these engagement means can similarly be changed into different designs as in a three-piece base.

In any of the embodiments, as already set forth, the second retaining member positioned on the outside of the retaining member or the outer peripheral portion of the base may be provided with an additional cooling function having plural holes for emitting heat generated during the grinding operation.

Referring to the rotary grinding jig in accordance with the first invention of the present application, since the base is composed of the retaining member and the central member formed independent from each other, if the grinding member has worn out entirely, only the grinding member and the retaining member may be removed and thrown away, and then, exchanged for new ones, while the central member can be continuously used rather then discarded. This may contribute to environmental protection, saving resources, and a reduction of production cost.

The retaining member and the central member can be removably fixed to each other by the rotative engagement means in a simple manner.

The existence of the retaining member enable the use of every type of grinding member of hard or soft quality.

When the retaining member and the central member are engaged with each other, both of them are loaded by the rotation of the rotating shaft of a rotary drive in a direction in which the engaging strength of the rotative engagement portions of both members are increased, thereby avoiding any disengagement of both members during the grinding operation.

Since the outer diameter of fixing means for fixing the central member to the rotating shaft is smaller than the inner diameter of the hollow portion of the retaining member and the retaining member and the grinding member can be removed with the central member kept in firm contact with the rotating shaft.

With the rotary grinding jig in accordance with the second embodiment of the present application, now that the grinding member and the retaining member for grinding member are molded so as to be combined into a unit of hard quality, a separate retaining member is not specifically needed.

In accordance with the rotary grinding jig of the third embodiment of the present application, the base is composed of three members, i.e. a central member, a first retaining member, and a second retaining member. Only the central member and second retaining member can repetitively be used, and only the worn-out grinding member and first retaining member are destined to be thrown away. However the grinding member can be so exhaustively used out that when a grinding member has worn out enough to be discarded the quantity of waste can be reduced to a minimum. This may contribute to saving resource and environmental protection, and a reduction of production cost as well.

Additionally, since the outer peripheral portion of the base (the second retaining member) is removably mounted, when the outer peripheral portion rests in its position, a workpiece being ground can be machined with the grinding member strongly pressed on the former, while in the absence of the peripheral portion, the grinding member may be softly pressed on the workpiece such that curved sections of the workpiece can be processed in an optimum manner.

In the rotary grinding jig in accordance with the fourth embodiment of the present application, because the central member can support and maintain the second retaining member on its rear side, the second retaining member can be combined with the first retaining member even if there exists no special engagement means between the first and second retaining members.

In the rotary grinding jig in accordance with the fifth embodiment of the present application, the engagement means for the first and second retaining members may avoid the necessity of supporting or maintaining by the central member of the second retaining member from the rear side.

In the rotary grinding jig in accordance with the sixth embodiment of the present application, if the rotating shaft of the rotary drive stops, the grinding member turns in a direction in which the engagement of the retaining member and the central member is dissolved, but such a turning can be checked by stopper means.

In the rotary grinding jig in accordance with the seventh embodiment of the present application, if the rotary drive of a grinder suddenly stops, the retaining member turns in a direction in which the engagement with the central member is dissolved, and then, will behave in a direction (the direction of the rotating shaft of the rotary drive) in which it separates from the central member, but its dropout-preventive means can help check eventual separation and dropout of the retaining member from the central member toward the rotating shaft of the rotary drive.

In the rotary grinding jig in accordance with the eighth embodiment of the present application, since the outer peripheral portion of the base is removably attached to the central member, if the grinding member mounted on the surface of the outer periphery becomes entirely worn, the outer peripheral portion may be removed from the central member for a further grinding operation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rotary grinding jig comprising:

a base fixed to a rotary shaft of a rotary drive of a grinder;

a grinding member provided on a surface side of said base, said base including:

a central member positioned in a center thereof and an outer peripheral portion positioned on a periphery thereof, said outer peripheral portion of the base being removably connected with the central member, and a grinding operation may be continuously resumed by removing the outer peripheral portion from the central member.

2. A rotary grinding jig, comprising:

a base having a grinding member provided on a surface thereof and a connecting portion formed in a center thereof for connecting said base to a rotating shaft of a rotary drive, said base including:

a retaining member provided with said grinding member thereon, said retaining member including a first retaining member and a second retaining member, said second retaining member being positioned on an outside of said first retaining member and removably attached to said first retaining member, said first retaining member including a hollow portion, said hollow portion including a through-hole in a center of said first retaining member and a rotative engagement portion defined on an inner edge portion of said through-hole;

a central member having said connecting portion formed thereon, said central member including a rotative engagement portion formed thereon, said connecting portion including a rotating shaft mounting hold for receiving the rotary shaft of the rotary drive therethrough, said central member being fixable to the rotary shaft by a fixing means, said fixing means being smaller in outer diameter that an inner diameter of said hollow portion of said first retaining member;

said rotative engagement portion of said first retaining member is engageable to mutually lock with said rotative engagement portion of said central member by turning in a direction opposite to a direction in which the rotary shaft rotates and disengageable with said rotative engagement portion of said central member by turning in the direction of rotation of the rotary shaft, the rotation of said rotary shaft causing further increase of the mutual locking between said rotative engagement positions; and wherein said retaining member is separable from said central member while said central member remains fixed to the rotary shaft by said fixing means, and said second retaining member is removable from said first retaining member upon wear of said grinding member in order to continuously perform a grinding operation.

3. The rotary grinding jig as defined in claim 2, wherein said grinding member and said retaining member are hard structures made of grindstones and resin and formed integral with each other.

4. The rotary grinding jig as defined in claim 2, wherein said second retaining member is retained by the central member on a rear side thereof with the first retaining member combined thereto.

5. The rotary grinding jig as defined in claim 4, wherein said engaging portions are provided on one of an outer peripheral edge portion of the first retaining member and an inner peripheral edge portion of the second retaining member, and engaged portions are formed on the other one of the outer peripheral edge portion of the first retaining member and the inner peripheral edge portion of the second retaining member, so that said first and second retaining members may be removably engaged with each other, said engaging portions and said engaged portions acting as engagement means to allow the second retaining member to cope with an axial force running from a surface side to a rear side thereof.

6. The rotary grinding jig as defined in claim 2, wherein engaging portions are provided on one of an outer peripheral edge portion of the first retaining member and an inner peripheral edge portion of the second retaining member, and engaged portions are formed on the other one of the outer peripheral edge portion of the first retaining member and the inner peripheral edge portion of the second retaining member, so that said first and second retaining members may be removably engaged with each other, said engaging portions and said engaged portions acting as engagement means to allow the second retaining member to cope with an axial force running from a surface side to a rear side thereof.

7. The rotary grinding jig as defined in claim 2, further comprising a stopper member, said stopper member being movable vertically and placed in a proper position of the central member for preventing the retaining member from turning in a direction of disengagement of the retaining member and the central member.

8. The rotary grinding jig as defined in claim 2, wherein when the retaining member turns in a direction of disengagement of the retaining member and the central member, a dropout-preventive means is placed in a proper position of the retaining member or the central member for preventing the retaining member from falling from the central member in the direction of the rotating shaft of the rotary drive.

* * * * *